US009261038B2

(12) United States Patent
Nishida et al.

(10) Patent No.: US 9,261,038 B2
(45) Date of Patent: Feb. 16, 2016

(54) VEHICLE ENGINE CONTROL SYSTEM

(71) Applicant: MITSUBISHI ELECTRIC CORPORATION, Chiyoda-ku, Tokyo (JP)

(72) Inventors: Mitsunori Nishida, Chiyoda-ku (JP); Osamu Nishizawa, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 262 days.

(21) Appl. No.: 13/766,013

(22) Filed: Feb. 13, 2013

(65) Prior Publication Data

US 2014/0067233 A1 Mar. 6, 2014

(30) Foreign Application Priority Data

Aug. 30, 2012 (JP) ..... 2012-189432

(51) Int. Cl.

| | |
|---|---|
| ***B60T 7/12*** | (2006.01) |
| ***G05D 1/00*** | (2006.01) |
| ***G06F 7/00*** | (2006.01) |
| ***G06F 17/00*** | (2006.01) |

(Continued)

(52) U.S. Cl.

CPC ..... *F02D 41/20* (2013.01); *F02D 41/28* (2013.01); *F02D 41/30* (2013.01); *F02M 51/06* (2013.01); *F02D 2041/202* (2013.01); *F02D 2041/2003* (2013.01); *F02D 2041/2027* (2013.01); *F02D 2041/2055* (2013.01)

(58) Field of Classification Search

CPC . F02D 41/20; F02D 2041/2003; F02D 41/28; F02D 2041/202; F02D 2041/2027; F02D 2041/2051; F02D 2041/2055; F02D 2041/2058; F02D 41/30; F02M 51/06

USPC ..... 123/472, 478, 479, 480; 701/101, 102, 701/103, 104, 105

See application file for complete search history.

(56) References Cited

U.S. PATENT DOCUMENTS 5,381,297 A * 1/1995 Weber ..... F02D 41/20 361/153
6,712,048 B2 * 3/2004 Aoki ..... F02D 41/20 123/490

(Continued)

FOREIGN PATENT DOCUMENTS

| | | | |
|---|---|---|---|
| JP | 2004-124890 | A | 4/2004 |
| JP | 2004-232493 | A | 8/2004 |
| JP | 2010-249069 | A | 11/2010 |

*Primary Examiner* — Mahmoud Gimie
*Assistant Examiner* — Sizo Vilakazi
(74) *Attorney, Agent, or Firm* — Sughrue Mion, PLLC; Richard C. Turner

(57) ABSTRACT

A calculation control circuit unit 110A is provided with a microprocessor 111, an auxiliary control circuit unit 190A, and a high-speed A/D converter 115 to which the detection signals of excitation currents for electromagnetic coils 81 through 84 are inputted; based on an valve-opening command signal generated by the microprocessor 111 and excitation-current setting information, the auxiliary control circuit unit 190A opening/closing-controls power supply control opening/closing devices by use of a numeral value comparator and a dedicated circuit unit, and monitors and stores at least one of the peak value of a rapid excitation current and a peak current reaching time; the microprocessor 111 performs correction control with reference to the monitoring storage data, and implements fuel injection control while reducing a rapid control load on the microprocessor 111.

14 Claims, 14 Drawing Sheets

(51) Int. Cl.

| | |
|---|---|
| ***F02D 41/20*** | (2006.01) |
| ***F02D 41/28*** | (2006.01) |
| ***F02D 41/30*** | (2006.01) |
| ***F02M 51/06*** | (2006.01) |

(56) References Cited

U.S. PATENT DOCUMENTS

| | | | | |
|---|---|---|---|---|
| 6,832,601 | B2 | 12/2004 | Watanabe et al. | |
| 6,880,530 | B2 | 4/2005 | Oyama et al. | |
| 2002/0189593 | A1* | 12/2002 | Yamakado | F02D 41/20 123/490 |
| 2004/0118384 | A1* | 6/2004 | Oyama | F02D 41/20 123/479 |
| 2004/0155121 | A1* | 8/2004 | Watanabe | F02D 41/20 239/533.2 |
| 2008/0083895 | A1* | 4/2008 | Ueda | F02D 41/20 251/129.15 |
| 2009/0015223 | A1* | 1/2009 | Kakehi | F02D 41/20 323/282 |
| 2009/0107469 | A1* | 4/2009 | Takahashi | F02D 41/20 123/490 |
| 2011/0220067 | A1* | 9/2011 | Okonogi | F02D 41/20 123/480 |
| 2011/0222202 | A1* | 9/2011 | Onda | F02D 41/20 361/152 |
| 2014/0020661 | A1* | 1/2014 | Nishimura | F02D 41/3005 123/480 |
| 2014/0034025 | A1* | 2/2014 | Nishimura | F02M 69/04 123/478 |

* cited by examiner

FIG. 4

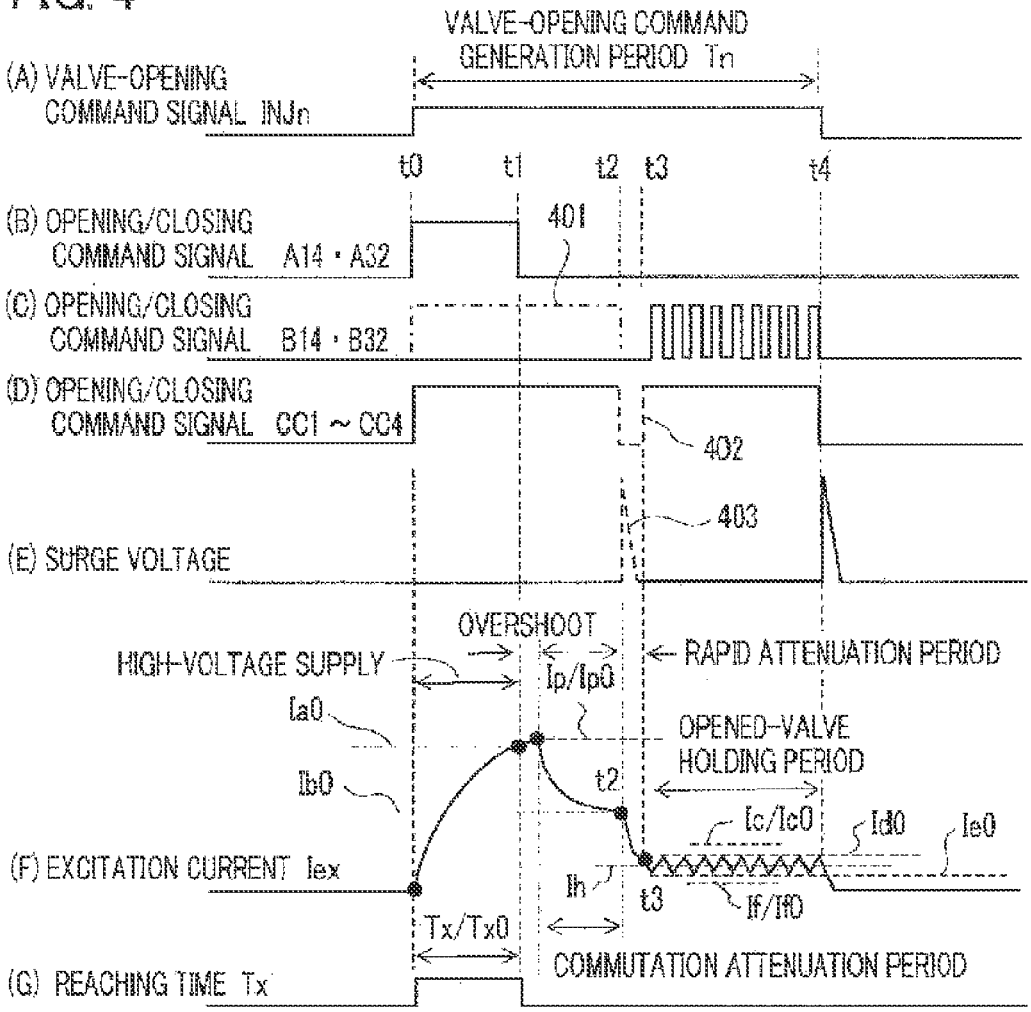

Tn VALVE-OPENING COMMAND GENERATION PERIOD
Tx ACTUALLY MEASURED REACHING TIME
Iex EXCITATION CURRENT
Ia0 SETTING CUTOFF CURRENT (RAPID EXCITATION COMPLETED)
Ip ACTUALLY MEASURED PEAK CURRENT (OVERSHOOT CURRENT)
Ib0 SETTING ATTENUATION CURRENT
Ic ACTUALLY MEASURED MAXIMUM HOLDING CURRENT
Id0 SETTING DOWNWARD REVERSAL HOLDING CURRENT
Ie0 SETTING UPWARD REVERSAL HOLDING CURRENT
If ACTUALLY MEASURED MINIMUM HOLDING CURRENT

Tx0 SETTING TARGET REACHING TIME
Ih OPENED-VALVE HOLDING CURRENT
Ip0 SETTING LIMITATION PEAK CURRENT
Ic0 SETTING UPPER LIMIT HOLDING CURRENT
If0 SETTING LOWER LIMIT HOLDING CURRENT

1110 BOOSTED HIGH VOLTAGE SUPPRESSION UNIT
1120 HOLDING CURRENT ADJUSTMENT UNIT 518 1ST CORRECTION CONTROL UNIT
528 2ND CORRECTION CONTROL UNIT
938 3RD CORRECTION CONTROL UNIT
908 2ND MONITORING CONTROL UNIT

VEHICLE ENGINE CONTROL SYSTEM

BACKGROUND OF THE INVENTION

1. Field of the Invention

The present invention relates to a microprocessor-incorporated vehicle engine control system in which, in order to rapidly drive the fuel-injection electromagnetic valve of an internal combustion engine, a boosted high voltage is instantaneously supplied from a vehicle battery to the electromagnetic coil for driving the electromagnet valve and valve-opening holding control is performed by means of the voltage of the vehicle battery; in particular, the present invention relates to a vehicle engine control system in which while the high-speed control load on the microprocessor is reduced, the control accuracy in fuel injection is raised.

2. Description of the Related Art

It is widely put into practice that for a plurality of electromagnetic coils that are provided at the respective cylinders of a multi-cylinder engine and drive the respective fuel-injection electromagnetic valves, a microprocessor that operates in response to the output of a crank angle sensor sequentially and selectively sets the respective valve opening and valve closing timings, and hardware provided outside the microprocessor performs rapid excitation control and opened-valve holding control so that rapid opening and opened-valve holding of the electromagnetic valve are implemented.

In general, in such an existing vehicle engine control system, the excitation current for the electromagnetic coil is monitored through an analogue signal voltage obtained by amplifying the voltage across a current detection resistor connected in series with the electromagnetic coil, and as the hardware provided outside the microprocessor, an analogue comparison circuit generates a logic signal for control. In this case, the comparison determination threshold value to be inputted to the comparison circuit is generated based on an analogue reference voltage; therefore, it is difficult for the microprocessor to correct the comparison determination threshold value.

However, there is publicly known a vehicle engine control system utilizing a method in which the detected signal voltage obtained from an excitation current is digital-converted by an A/D converter and a comparison determination threshold value is digitally set. For example, Patent Document 1, listed below, discloses a fuel injection valve control apparatus that makes it possible to implement stable fuel injection even when the voltage of a vehicle battery fluctuates and to implement limp-home operation against the abnormality in an opening/closing device or an auxiliary power source that generates a boosted high voltage.

According to FIG. 1 in Patent Document 1, the voltage across a current detection device (current detection resistor) 29 connected in series with an electromagnetic solenoid (electromagnetic coil) 27 is inputted to an A/D converter 32 by way of an amplifier 31; in response to a valve opening signal (valve-opening command signal) PL1 generated by a microprocessor 4a and the present value of an excitation current that has been digital-converted by an A/D converter 32, a logic circuit 16 generates control signals A, B, and C; then, as represented in the timing chart of FIG. 2, a first opening/closing device (high-voltage opening/closing device) 20 implements rapid excitation control, a second opening/closing device 24 implements opened-valve holding control, and a third opening/closing device (selective opening/closing device) 28 implements selective conduction and rapid cutoff control.

On the other hand, there is also publicly known a technology of monitoring the generation condition of a rapid excitation current in a typical vehicle engine control system utilizing a method in which the detected signal voltage obtained from an excitation current, left as an analogue signal, is utilized and a comparison determination value is set with an analogue value. For example, Patent Document 2, listed below, discloses a technology in which according to FIGS. 3 and 5, a fuel injection control apparatus is provided with switching devices 50, 51, and 52, a current detection resistor 60, a fuel injection valve drive IC56, and an engine control unit ECU19.

In response to a valve-opening command signal generated by ECU19 and a current detection signal voltage obtained through the current detection resistor 60, IC56 in Patent Document 2 closes the switching devices 50 and 52 based on a valve opening command of the injection pulse width Ti. The value of an excitation current at a time when a circuit-closing drive time Th has elapsed is compared with a target peak current Ipeak, which is a predetermined determination threshold value; in the case where an actually measured current exceeds the target peak current Ipeak, the valve-opening voltage (boosted high voltage) VH is recurrently and slightly decreased until the actually measured current and the target peak current Ipeak coincide with each other. In the case where the actually measured current is smaller than the target peak current Ipeak, the valve-opening voltage (boosted high voltage) VH is recurrently and slightly increased until the actually measured current and the target peak current Ipeak coincide with each other. In other words, control is performed in such a way that the predetermined peak current Ipeak can always be obtained at a time when the predetermined circuit-closing drive time Th has elapsed, so that the valve-opening control accuracy is raised.

According to FIGS. 2 through 5 and 7 in Patent Document 3, listed below, a fuel supply system is provided with a microprocessor 24 that generates a valve opening signal 24a and a holding signal 24b, a voltage boosting circuit 32, switches 33, 34, 36, and 37, an upstream current detectors 53 and 56, a downstream current detector 63, a control unit 39, and a diagnosis unit 41; the control unit 39 performs rapid excitation control in response to the valve opening signal 24a and the holding signal 24b generated by the microprocessor 24 and a signal voltage proportional to a rapid excitation current obtained through the upstream current detectors 53; the diagnosis unit 41 measures an elapsed time T2 in which the rapid excitation current reaches a predetermined peak current 71, and in the case where the elapsed time T2 is too short, the diagnosis unit 41 determines that there exists a shortcircuit abnormality in an electromagnetic coil 13 or a short-to-ground abnormality of the positive line and reports the determination to the microprocessor 24 through serial communication 24c.

PRIOR ART REFERENCE

Patent Document

[Patent Document 1] Japanese Patent Application Laid-Open No. 2004-232493

[Patent Document 2] Japanese Patent Application Laid-Open No. 2010-249069

[Patent Document 3] Japanese Patent Application Laid-Open No. 2004-124890

(1) Explanation for Problems in the Prior Art

The fuel injection valve control apparatus disclosed in Patent Document 1 is characterized in that because rapid excitation control and opened-valve holding control are performed by the logic circuit 16 provided outside the microprocessor 4a, the rapid control load on the microprocessor 4a is reduced. However, a peak current Ia, a sustained power supply final value Ib, an attenuation determination current Ic, a holding-current target upper limit value Id, and a holding-current target lower limit value Ie, which are determination threshold values for logic control, are digitally set, as fixed control constants, in the logic circuit 16; thus, the microprocessor 4a can neither adjust these determination threshold values nor monitor the state of excitation-current control by the logic control 16.

In the fuel injection control apparatus disclosed in Patent Document 2, the boosted high voltage is slightly increased or decreased so that feedback control is performed in such a way that the generation time and the peak current value of a rapid excessive excitation current become equal to the predetermined circuit-closing drive time TH and the target peak current Ipeak. However, a switching device has an opening-circuit response delay time, and this delay time changes depending on the ambient temperature of the switching device and the rising gradient of a rapid excitation current also fluctuates because the resistance value of the electromagnetic coil changes depending on the temperature; therefore, there has been a problem that the excitation current at a time when the circuit-closing drive time TH has elapsed is different from the actual peak current and hence right correction control cannot be implemented without actually measuring the peak current itself, which is an unspecified value.

In the fuel supply system disclosed in Patent Document 3, a timer in the diagnosis unit 41 provided outside the microprocessor 24 measures the rising state of a rapid excitation current, and the diagnosis result is reported to the microprocessor 24; however, the diagnosis contents are provided in order to detect a shortcircuit abnormality in the electromagnetic coil or a short-to-ground abnormality of the positive line so as to prevent a burning accident; thus, it is not made possible to perform correction control for preventing the valve-opening characteristics from fluctuating because the rising characteristics of the rapid excitation current is slightly deviated. For the control unit 39 formed mainly of a logic circuit, it is an excessive load to calculate the difference time between the timer's measurement time and the target time in order to determine whether or not the rising characteristics of a rapid excitation current is slightly deviated and to perform correction control corresponding to the difference time.

SUMMARY OF THE INVENTION

(2) Explanation for the Objective of the Present Invention

The first objective of the present invention is to provide a vehicle engine control system in which for the purpose of controlling the excitation current of the electromagnetic coil for fuel injection, there is provided an auxiliary control circuit unit that collaborates with a microprocessor, thereby reducing rapid control load on the microprocessor, and in which the microprocessor can readily adjust the control characteristics of the excitation current so that the control accuracy in fuel injection can be raised.

The second objective of the present invention is to provide a vehicle engine control system in which the state of controlling the excitation current is constantly monitored so that for a disturbance including the fluctuation of the electromagnetic coil due to a temperature change therein, the control accuracy in fuel injection can be maintained without increasing the rapid control load on the microprocessor.

In order to sequentially drive fuel-injection electromagnetic valves provided on the respective cylinders of a multi-cylinder engine, a vehicle engine control system according to the present invention includes an input/output interface circuit unit for two or more groups of electromagnetic coils that drive the electromagnetic valves, a voltage boosting circuit unit that generates a boosted high voltage for rapidly exciting the electromagnetic coils, and a calculation control circuit unit formed mainly of a microprocessor. The vehicle engine control system according to the present invention is characterized in the following manner.

The two or more groups of electromagnetic coils include at least a first group of electromagnetic coils and a second group of electromagnetic coils, which are two or more groups of electromagnetic coils that perform fuel injection alternately and sequentially among the groups.

The input/output interface circuit unit is provided with a power supply control opening/closing devices including a first low-voltage opening/closing device that connects the first group of electromagnetic coils with a vehicle battery and a second low-voltage opening/closing device that connects the second group of electromagnetic coils with the vehicle battery, a first and second high-voltage opening/closing devices that are connected with the output of the voltage boosting circuit unit, and respective selective opening/closing devices separately connected with the electromagnetic coils and with a first and second current detection resistors that are connected with the first and second electromagnetic coils, respectively.

The calculation control circuit unit is provided with a low-speed multichannel A/D converter, a high-speed multichannel A/D converter, and an auxiliary control circuit unit that collaborate with the microprocessor.

Low-speed-change analogue sensors including an air flow sensor that detects an intake amount of the multi-cylinder engine and a fuel pressure sensor for injection fuel are connected with the multi-channel A/D converter; and digital conversion data proportional to a signal voltage of each of the sensors is stored in a buffer memory connected with the microprocessor through a bus line.

Respective analogue signal voltages proportional to the voltages across the first and second current detection resistors are inputted to the high-speed A/D converter; and multi-input-channel digital conversion data pieces obtained by the high-speed A/D converter are stored in a first and second present value registers.

The auxiliary control circuit unit includes a first numeral value comparator that compares a value stored in a first setting value register with a value stored in the first present value register and a second numeral value comparator that compares a value stored in a second setting value register with a value stored in the second present value register, a first and second high-speed timers and at least one of a first and second peak-hold registers, and a first and second dedicated circuit units.

The first numeral value comparator and the second numeral value comparator compare setting data pieces that are sent from the microprocessor, preliminarily stored in the first setting value register and the second setting value register, and serve as control constants for excitation currents for the electromagnetic coils with actually measured data pieces proportional to the present values, of the excitation currents, that are stored in the first and second present value registers; then, the first numeral value comparator and the second numeral value comparator generate a first and second determination logic outputs.

In response to the signal voltages, from the air flow sensor and the fuel pressure sensor, that are inputted to the multichannel A/D converter and the operation of the crank angle sensor, which is one of the opening/closing sensors, the microprocessor determines generation timings and valve-opening command generation periods of the valve-opening command signals for the electromagnetic coils.

In response to the valve-opening command signals and the first and second determination logic outputs, the first and second dedicated circuit units generate a opening/closing command signals including a first and second high-voltage opening/closing command signals for the first and second high-voltage opening/closing devices, a first and second low-voltage opening/closing command signals for the first and second low-voltage opening/closing devices, and a selective opening/closing command signals for the selective opening/closing devices.

The first and second high-speed timers measure and store, as an actually measured reaching time, the time from a time point when the valve-opening command signal is generated and any one of the first and second high-voltage opening/closing devices and the selective opening/closing devices is driven to close to a time point when the excitation current for the electromagnetic coil reaches a predetermined setting cut-off current.

The first and second peak-hold registers store, as an actually measured peak currents, the maximum values of the first and second present value registers during a period in which the valve-opening command signals are generated.

The microprocessor is further provided with correction control units that read monitoring storage data, which is the actually measured reaching time or the actually measured peak current, that monitor a generation state of the rapid excitation current, and that adjust setting data for the first and second setting value registers or a valve-opening command generation period of the valve-opening command signal in such a way that the amount of fuel injection by the fuel-injection electromagnetic valve becomes a desired value.

As described above, a vehicle engine control system according to the present invention is configured with a voltage boosting circuit unit, an input/output interface circuit unit for a plurality of fuel-injection electromagnetic coils, and a calculation control circuit unit; the calculation control circuit unit is provided with a low-speed multichannel A/D converter, a high-speed multichannel A/D converter, and an auxiliary control circuit unit that collaborate with a microprocessor, and the auxiliary control circuit unit is provided with a plurality of numeral value comparators, a plurality of high-speed timers or peak-hold registers, and a dedicated circuit unit; in response to a valve-opening command signal generated by the microprocessor, the numeral value comparators and the dedicated circuit unit open or close power supply control opening/closing devices for the electromagnetic coils; the high-speed timer or the peak-hold register monitors and stores the generation state of a rapid excitation current for the electromagnetic coil; the microprocessor refers to the monitoring storage data and then performs correction control for the electromagnetic coil.

Accordingly, by use of a setting value register, the microprocessor can readily adjust setting data that serves as a control constant; the auxiliary control circuit unit performs logic control in which the opening/closing of a plurality of power supply control opening/closing devices is controlled in synchronization with the engine rotation, and stores monitoring information related to the generation state of a rapid excitation current; the microprocessor performs calculation control based on the monitoring storage information provided from the auxiliary control circuit unit and can perform correction control so as to obtain a desired fuel injection amount. Therefore, there is demonstrated an effect that the rapid control load on the microprocessor is reduced and hence the accuracy of fuel injection control can be raised.

The foregoing and other object, features, aspects, and advantages of the present invention will become more apparent from the following detailed description of the present invention when taken in conjunction with the accompanying drawings.

BRIEF DESCRIPTION OF THE DRAWINGS

FIG. 4 is a timing chart for explaining the operation of a vehicle engine control system according to Embodiment 1 of the present invention;

DETAILED DESCRIPTION OF THE PREFERRED EMBODIMENTS

Embodiment 1

(1) Detailed Description of Configuration

Figure 1:
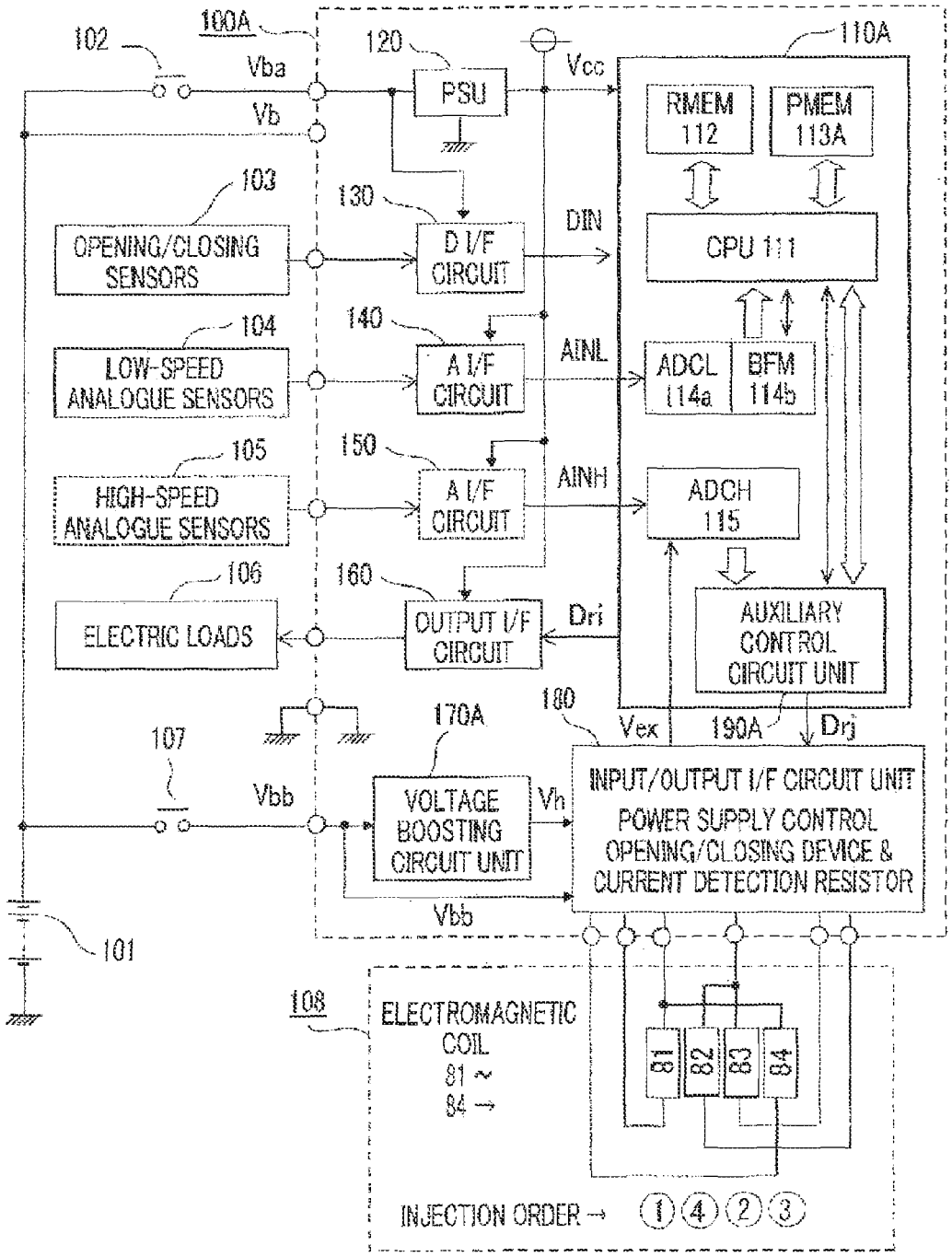
FIG. 1 is a block diagram illustrating the overall configuration of a vehicle engine control system according to Embodiment 1 of the present invention.

Hereinafter, there will be explained a vehicle engine control system according to Embodiment 1 of the present invention. FIG. 1 is a block diagram illustrating the overall configuration of a vehicle engine control system according to Embodiment 1 of the present invention. In FIG. 1, a vehicle engine control system 100A is configured mainly with a calculation control circuit unit 110A configured as a one-chip or two-chip integrated circuit device, an input/output interface circuit unit 180 for after-mentioned electromagnetic coils 81 through 84 provided on respective fuel-injection electromagnetic valves, and a voltage boosting circuit unit 170A that functions as a high-voltage power source for rapidly exciting the electromagnetic coils 81 through 84.

At first, a vehicle battery 101 connected with the outside of the vehicle engine control system 100A directly supplies a battery voltage Vb to the vehicle engine control system 100A and supplies a main power source voltage vba to the vehicle engine control system 100A by way of a control power source switch 102. The control power source switch 102 serves as the output contact of a main power source relay that is closed when an unillustrated power switch is closed and is opened when a predetermined time elapses after the power switch is opened. When the main power source switch 102 is opened, the battery voltage Vb directly supplied from the vehicle battery 101 maintains the storage status of an after-mentioned RAM memory 112.

The vehicle battery 101 also supplies a load driving voltage vbb to the vehicle engine control system 100A by way of a load power source switch 107; the load power source switch 107 serves as the output contact of a load power source relay that is energized through a command from a microprocessor 111. Opening/closing sensors 103 are, for example, opening/closing sensors such as a rotation sensor for detecting the rotation speed of an engine, a crank angle sensor for determining a fuel injection timing, and a vehicle speed sensor for detecting a vehicle speed, and include manual operation switches such as an accelerator pedal switch, a brake pedal switch, a parking brake switch, a shift switch for detecting the shift lever position of a transmission.

Analogue sensors 104 include analogue sensors, for performing driving control of an engine, such as an accelerator position sensor for detecting an accelerator pedal depression degree, a throttle position sensor for detecting an intake throttle valve opening degree, an air flow sensor for detecting an intake amount of an engine, a fuel pressure sensor for an injection fuel, an exhaust-gas sensor for detecting the oxygen concentration in an exhaust gas, and an engine coolant temperature sensor (in the case of a water-cooled engine); these sensors are low-speed-change analogue sensors whose changing speeds are rather slow.

Analogue sensors 105 are, for example, knock sensors for detecting compression/combustion vibration; these knock sensors are utilized as sensors for adjusting ignition timing, when the vehicle engine is a gasoline engine. Electric loads 106 driven by the vehicle engine control system 100A include, for example, main apparatuses such as an ignition coil (in the case of a gasoline engine) and an intake valve opening degree control monitor and auxiliary apparatuses such as a heater for an exhaust-gas sensor, a power source relay for supplying electric power to a load, an electromagnetic clutch for driving an air conditioner, and an alarm/display apparatus. The electromagnetic coils 81 through 84, which are specific electric loads among the electric loads, are to drive an electromagnetic valve 108 for performing fuel injection; a plurality of electromagnetic coils 81 through 84 are switched to be sequentially connected with the vehicle engine control system 100A by after-mentioned selective opening/closing devices, provided in the respective cylinders, and fuel injection for the respective cylinders of a multi-cylinder engine is performed.

In the case of an inline-four-cylinder engine, among the respective electromagnetic coils 81 through 84 provided for the cylinders 1 through 4, the electromagnetic coils 81 and 84 for the cylinders 1 and 4, which are arranged outside form a first group, and the electromagnetic coils 83 and 82 for the cylinders 3 and 2, which are arranged inside form a second group. Fuel injection is circularly implemented, for example, in the following order: the electromagnetic coil 81→the electromagnetic coil 83→the electromagnetic coil 84→the electromagnetic coil 82→the electromagnetic coil 81; the electromagnetic coils 81 and 84 in the first group and the electromagnetic coils 83 and 82 in the second group alternately implement fuel injection so as to reduce vehicle vibration. In the case of an inline-six-cylinder engine and an inline-eight-cylinder engine, respective electromagnetic coils separated into first and second groups also alternately implement fuel injection so as to reduce vehicle vibration; the respective valve-opening command signals for the electromagnetic coils in a single and the same group do not overlap with one another.

Next, explaining the internal configuration of the vehicle engine control system 100A, the calculation control circuit unit 110A is configured with the microprocessor 111; the RAM memory 112 for calculation processing; a nonvolatile program memory 113A, which is, for example, a flash memory; an low-speed-operation and multichannel A/D converter 114*a*, which is, for example, a sequential-conversion type and converts a 16-channel analogue input signal into digital data; a buffer memory 114*b* in which digital conversion data obtained through conversion by the multichannel A/D converter 114*a* is stored and which is connected with the microprocessor 111 through a bus line; a high-speed A/D converter 115, which is, for example, a delta-sigma type and converts a 6-channel analogue input signal into digital data; and an after-mentioned auxiliary control circuit unit 190A in which digital conversion data obtained through conversion by the high-speed A/D converter 115 is stored and which is connected with the microprocessor 111.

The program memory 113A can perform electric collective erasure on a basis of a block; some blocks are utilized as nonvolatile data memories in which important data in the RAM memory 112 is stored.

The constant voltage power source 120 is supplied with electric power by the vehicle battery 101 by way of the control power source switch 102 and generates a control power-source voltage Vcc of, for example, DC 5 V and supplies the control power-source voltage Vcc to the calculation control circuit unit 110A; the constant voltage power source 120 is also supplied with electric power directly by the vehicle battery 101 and generates a backup power source of, for example, 2.8 V for storing and holding data in the RAM memory 112. An opening/closing input interface circuit 130 is inserted between the opening/closing sensors 103 and a digital input port DIN of the calculation control circuit unit 110A and performs voltage level conversion and noise suppression processing.

The opening/closing input interface circuit 130 operates by being supplied with the main power source voltage vba. A low-speed analogue input interface circuit 140 is inserted between the analogue sensors 104 and an analogue input port AINL of the calculation control circuit unit 110A and performs voltage level conversion and noise suppression processing; the low-speed analogue input interface circuit 140 operates with the control power-source voltage Vcc as a power source.

A high-speed analogue input interface circuit 150 is inserted between the analogue sensors 105 and an analogue input port AINH of the calculation control circuit unit 110A and performs voltage level conversion and noise suppression processing; the high-speed analogue input interface circuit 150 operates with the control power-source voltage Vcc as a power source. In an application where the analogue sensors 105 for a high-speed change are not utilized, the high-speed analogue input interface circuit 150 is not required; however, the high-speed A/D converter 115 has an important role, as described later.

An output interface circuit 160 is formed of a plurality of power transistors that drive the electric loads 106 excluding the electromagnetic coil 108, which is a specific electric load, in response to a load drive command signal Dri generated by the calculation control circuit unit 110A; the electric loads 106 are supplied with electric power by the vehicle battery 101 by way of the output contact of an unillustrated load power source relay.

The voltage boosting circuit unit 170A, which is supplied with the load driving voltage vbb by way of the load power source switch 107, generates, with an after-mentioned configuration, a boosted high voltage Vh of, for example, DC 72 V. The boosted high voltage Vh and the load power source voltage vbb are applied to the input/output interface circuit unit 180, described later, with which the plurality of electromagnetic coils 81 through 84 are connected; the input/output interface circuit unit 180 is provided with a power supply control opening/closing device that performs opening/closing operation in response to an opening/closing command signal Drj from the auxiliary control circuit unit 190A and current detection resistors for the electromagnetic coils 81 through 84, and inputs a current detection signal Vex, which is a signal voltage proportional to the excitation current, to the high-speed A/D converter 115.

Figure 2:
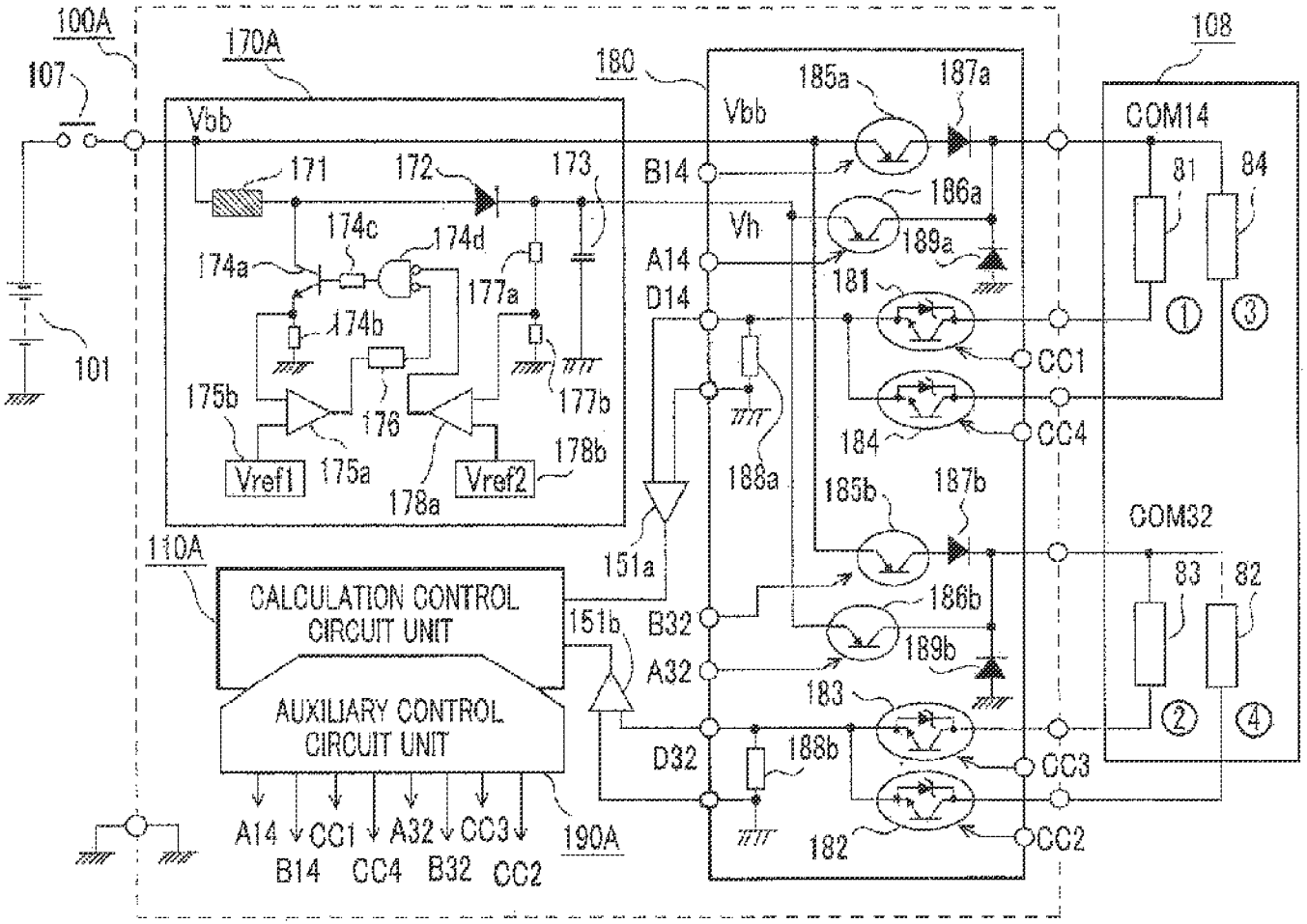
FIG. 2 is a block diagram illustrating the detail of part of a control circuit in a vehicle engine control system according to Embodiment 1 of the present invention.

Next, part of the control circuit in the internal combustion engine control system illustrated in FIG. 1 will be explained. FIG. 2 is a block diagram illustrating the detail of part of the control circuit in a vehicle engine control system according to Embodiment 1 of the present invention. In FIG. 2, the voltage boosting circuit unit 170A is configured mainly with an induction device 171, a charging diode 172, and a high-voltage capacitor 173 which are connected in series with one another and to which the load power source voltage vbb is applied, a voltage boosting opening/closing device 174 connected in series with the induction device 171, and a current detection resistor 174*b*; when the voltage boosting opening/closing device 174*a* closes and a current flowing in the induction device 171 becomes the same as or larger than a predetermined value, the voltage boosting opening/closing device 174*a* is opened and then electromagnetic energy that has been stored in the induction device 171 is discharged to the high-voltage capacitor 173 by way of the charging diode 172; by making the voltage boosting opening/closing device 174*a* turn on/off several times, the boosted high voltage Vh, which is the voltage charged across the high-voltage capacitor 173, rises up to a target predetermined voltage.

A first comparator 175*a* compares the voltage across the current detection resistor 174*b* with a first threshold voltage 175*b*. In the case where the voltage across the current detection resistor 174*b* is lower than the first threshold voltage Vref1, the first comparator 175*a* performs circuit-closing drive of the voltage boosting opening/closing device 174*a* by way of a timer circuit 176, a gate device 174*d*, and a driving resistor 174*c*. When the voltage across the current detection resistor 174*b* becomes the same as or higher than the first threshold voltage Vref1, the drive of the voltage boosting opening/closing device 174*a* is immediately stopped, and the voltage across the current detection resistor 174*b* rapidly decreases to zero, i.e., again becomes lower than the first threshold voltage Vref1; however, during a predetermined period, the operation of the timer circuit 176 maintains the voltage boosting opening/closing device 174*a* in an opening state.

A second comparator 178*a* compares a divided voltage obtained through division resistors 177*a* and 177*b* that are connected across the high-voltage capacitor 173 with a second threshold voltage 178*b*. When the divided voltage exceeds the second threshold voltage Vref2, the drive of the voltage boosting opening/closing device 174*a* is stopped by the intermediary of the gate device 174*d*.

The input/output interface circuit unit 180 is configured with a series circuit consisting of a first low-voltage opening/closing device 185*a* and a first reverse-flow prevention diode 187*a* for applying the load power source voltage vbb to a common terminal COM14 of the electromagnetic coils 81 and 84 in the first group; a first high-voltage opening/closing device 186*a* for applying the boosted high voltage Vh; respective selective opening/closing devices 181 and 184 separately provided at the downstream sides of the electromagnetic coils 81 and 84; a first current detection resistor 188*a* provided at the common downstream side of the selective opening/closing devices 181 and 184; and a commutation diode 189*a* connected in parallel with the series circuit consisting of the respective electromagnetic coils 81 and 84, the respective selective opening/closing devices 181 and 184, and the first current detection resistor 188*a*.

Similarly, a second low-voltage opening/closing device 185*b* and a second reverse-flow prevention diode 187*b*, a second high-voltage opening/closing device 186*b*, respective selective opening/closing devices 182 and 183 and a second current detection resistor 188*b*, and a second commutation diode 189*b* are connected with the electromagnetic coils 83 and 82 in the second group. The selective opening/closing devices 181 through 184 include a voltage limiting function for absorbing a surge voltage that is generated when any one of the excitation currents for the electromagnetic coils 81 through 84 is cut off.

The auxiliary control circuit unit 190A that collaborates with the calculation control circuit unit 110A generates a first high-voltage opening/closing command signal A14 and a first low-voltage opening/closing command signal B14, as opening/closing command signals Drj, and drives the first high-voltage opening/closing device 186*a* and the first low-voltage opening/closing device 185*a*, respectively, so as to close these opening/closing devices, and generates selective opening/closing command signals CC1 and CC4 and drive the selective opening/closing devices 181 and 184, respectively, so as to close these selective opening/closing devices. Similarly, the auxiliary control circuit unit 190A generates a second high-voltage opening/closing command signal A32 and a second low-voltage opening/closing command signal B32 and drives the second high-voltage opening/closing device 186*b* and the second low-voltage opening/closing device 185*b*, respectively, so as to close these opening/closing devices, and generates selective opening/closing command signals CC3 and CC2 and drive the selective opening/closing devices 183 and 182, respectively, so as to close these selective opening/closing devices.

Current detection signals D14 and D32, which are respective voltages across the first and second current detection resistors 188*a* and 188*b*, are inputted, as a two-channel current detection signal voltage Vex (refer to FIG. 1), to the high-speed A/D converter 115 by way of an unillustrated input filter circuit and first and second differential amplifiers 151*a* and 151*b*.

Figure 3:
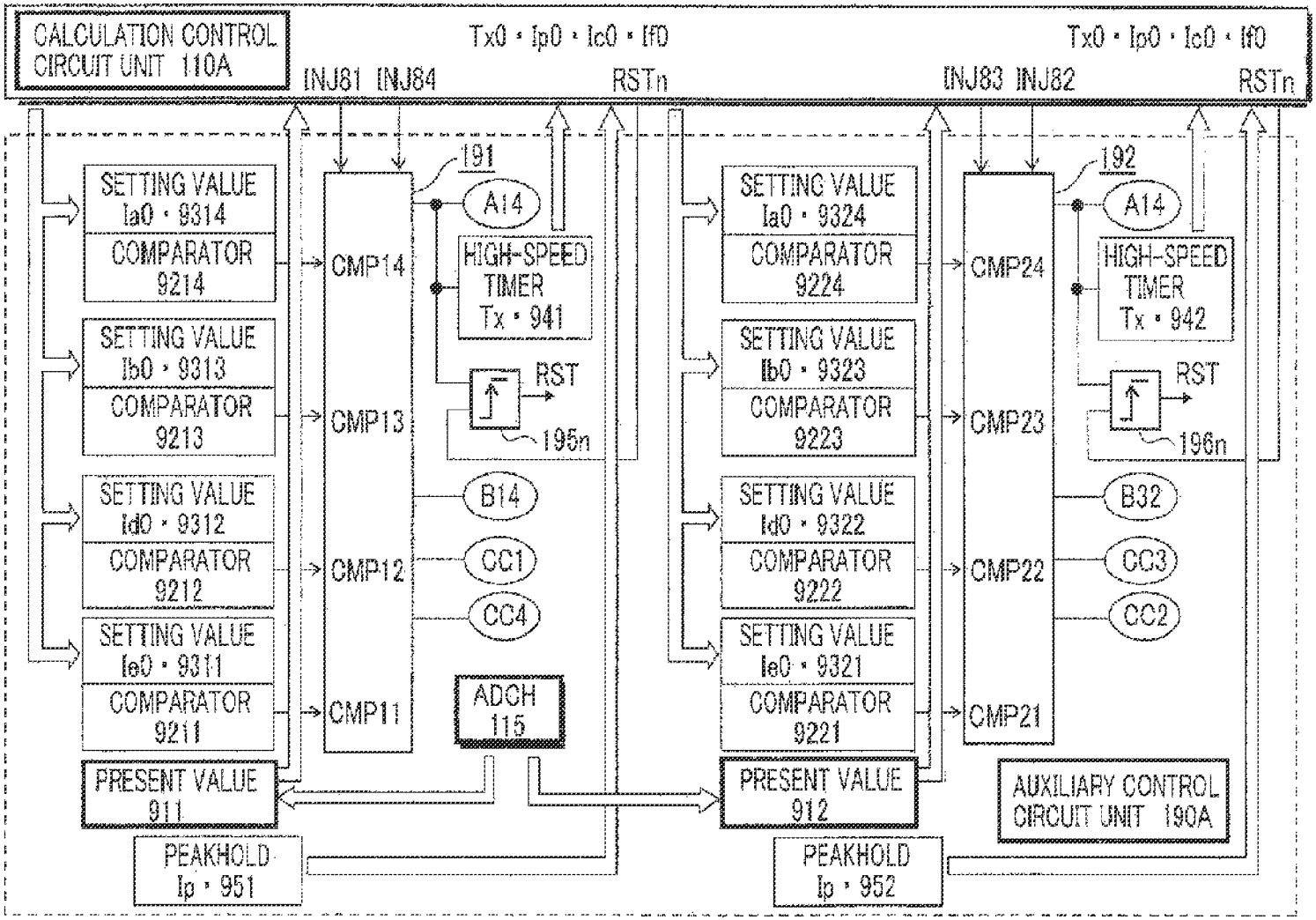
FIG. 3 is a block diagram illustrating the detail of an auxiliary control circuit unit in a vehicle engine control system according to Embodiment 1 of the present invention.

FIG. 3 is a block diagram illustrating the detail of an auxiliary control circuit unit in a vehicle engine control system according to Embodiment 1 of the present invention. In FIG. 3, the auxiliary control circuit unit 190A is configured mainly with a first present value register 911 in which the present value of a digital conversion value proportional to the excitation current for the electromagnetic coil 81 or 84 in the first group is stored and a second present value register 912 in which the present value of a digital conversion value proportional to the excitation current for the electromagnetic coil 83 or 82 in the second group is stored.

First numerical value comparators 9211 through 9214 in the first group compare the contents of the first present value register 911 with the contents of first setting value registers 9311 through 9314 in which setting data items, transmitted from the calculation control circuit unit 110A, that become control constants Ie0, Id0, Ib0 and Ia0 are stored; then, the first numerical value comparators 9211 through 9214 create first determination logic outputs CMP11 through CMP14.

Based on valve-opening command signals INJ81 and INJ84 generated by the calculation control circuit unit 110A and the logic states of the first determination logic outputs CMP11 through CMP14, a first dedicated circuit unit 191 generates the opening/closing command signals A14, B14, CC1, CC4 in accordance with the logic described later with reference to FIG. 4. A first high-speed timer 941 measures and stores, as an actually measured reaching time Tx, the time from a time point when the valve-opening command signal INJ81 or INJ84 is generated and any one of the first high-voltage opening/closing device 186*a* and the selective opening/closing device 181 or 184 is driven to close to a time point when an excitation current Iex of the electromagnetic coil 81 or 84 reaches a predetermined setting cutoff current Ia0.

A first peak-hold register 951 reads the value of the first present value register 911 during the period when the valve-opening command signal INJ81 or INJ84 is being generated; in the case where the present reading value is larger than the past reading and storage value, the first peak-hold register 951 updates the past one so as to store, as an actually measured peak current Ip, the maximum value obtained after the reading has been started.

Monitoring storage data stored in each of the present value resister of the first high-speed timer 941 and the first peak-hold register 951 is directly initialized, through a reset circuit, by a short-time differential pulse at a time immediately after the valve-opening command signal INJ81 or INJ84 has been generated; then, new monitoring storage data is updated and stored. In this regard, however, it is also made possible that a first gate circuit 195*n* is provided in the reset circuit and the initialization is enabled when the calculation control circuit unit 110A generates a reset permission command signal RSTn.

After the monitoring storage operation is completed, the monitoring storage data stored in each of the present value resister of the first high-speed timer 941 and the first peak-hold register 951 is held as it is when no initialization processing is performed, and new monitoring storage operation based on the next valve-opening command signals INJ81 and INJ84 is not performed.

Similar operation is performed in a second numeral value comparators 9221 through 9224, second setting value registers 9321 through 9324, a second dedicated circuit unit 192, a second high-speed timer 942, a second peak-hold register 952, and a second gate circuit 196*n* surrounding the second present value register 912 related to the electromagnetic coils 83 and 82 in the second group. Based on valve-opening command signals INJ831 and INJ82 generated by the calculation control circuit unit 110A and the logic states of second determination logic outputs CMP21 through CMP24, a second dedicated circuit unit 192 generates the opening/closing command signals A32, B32, CC3, CC2 in accordance with the logic described later with reference to FIG. 4.

Based on a control program, which is described later with reference to FIGS. 5A and 5B, the calculation control circuit unit 110A reads the contents of the present value registers of the first and second high-speed timers 941 and 942 and the contents of the first and second peak-hold registers 951 and 952, and monitors the generation states of the excitation currents Iex for the electromagnetic coils 81 through 84; then, the calculation control circuit unit 110A adjusts the setting values of the first and second setting value registers 9311 through 9314 and 9321 through 9324 or valve-opening command generation periods Tn for the valve-opening command signals INJ81 through INJ84 so that the generation states become target generation states.

The values of a setting cutoff current Ia0, a setting attenuation current Ib0, a setting downward reversal holding current Id0, and a setting upward reversal holding current Ie0, as the setting constants to be stored in the first setting value registers 9311 through 9314 and the second setting value registers 9321 through 9324, are obtained in such a manner that the values thereof preliminarily stored in the program memory 113A in the calculation control circuit unit 110A are transmitted to the RAM memory 112 when the driving is started, and then the transmitted data is further transferred to each of the registers.

With regard to a setting target reaching time Tx0 corresponding to the actually measured reaching time Tx measured by the first and second high-speed timer 941 and 942, a setting limitation peak current Ip0 corresponding to the actually measured peak current Ip to be stored in the first and second peak-hold registers 951 and 952, a setting upper limit holding current Ic0 for determining an abnormality in the setting downward reversal holding current Id0, and a setting lower limit holding current If0 for determining an abnormality in the setting upward reversal holding current Ie0, the values thereof preliminarily stored in the program memory 113A in the calculation control circuit unit 110A are transferred to the RAM memory 112 when the driving is started and utilized as data for performing correction control and abnormality monitoring by the microprocessor 111.

(2) Detailed Description of Operation

Hereinafter, there will be explained the operation of the vehicle engine control system, configured in such a manner as illustrated in FIG. 1, according to Embodiment 1 of the present invention, based on the timing chart represented in FIG. 4 for explaining the operation and the flowcharts represented in FIGS. 5A and 5B for explaining the operation. At first, in FIG. 1, when an unillustrated power switch is closed, the control power source switch 102, which is the output contact of the power supply relay, is closed, whereby the main power source voltage vba is applied to the vehicle engine control system 100A. As a result, the constant voltage power source 120 generates a control power source Vcc of, for example, DC 5V and then the microprocessor 111 starts its control operation.

In response to the operation statuses of the opening/closing sensors 103, the low-speed-change analogue sensors 104, and the high-speed-change analogue sensors 105 and the contents of the control program stored in the nonvolatile program memory 113A, the microprocessor 111 energizes the load power supply relay so as to close the load power source switch 107; concurrently, the microprocessor 111 generates the load-driving command signals Dri to the electric loads 106 and the opening/closing command signals Drj to the electromagnetic coils 81 through 84, which are the specific electric loads among the electric loads 106. On the other hand, the voltage boosting circuit unit 170A charges the high-voltage capacitor 173 with a high voltage when the voltage boosting opening/closing device 174*a* intermittently opens and closes.

Next, the operation of the vehicle engine control system illustrated in FIG. 1 will be explained with reference to a timing chart. FIG. 4 is a timing chart for explaining the operation of a vehicle engine control system according to Embodiment 1 of the present invention. FIG. 4(A) represents the logic waveforms of the valve-opening command signals INJ81 through INJ84 (sometimes referred to as INJn, collectively) that are sequentially generated by the microprocessor 111; the waveform becomes the logic level "H" at a calculation time point t0 before the top death center of a cylinder, which is a subject of fuel injection, and the valve-opening command is generated; then, at a time point t4 when the valve-opening command generation periods Tn has elapsed, the waveform becomes the logic level "L" and the valve-opening command is cancelled.

The valve-opening command generation periods Tn is in proportion to the intake amount [gr/sec] of the intake pipe detected by an air flow sensor and in inverse proportion to the engine rotation speed [rps] and the average flow rate [gr/sec] of supplied fuel at a time when the valve is opened; the higher the fuel pressure of the supplied fuel is, the higher the average flow rate becomes.

FIG. 4(B) is a logic waveform of the high-voltage opening/closing command signal A 14 (A32); for example, when the valve-opening command signal INJ81 or INJ84 is generated, the logic level of the high-voltage opening/closing command signal A14 becomes "H" during the period from the time point t0 to an after-mentioned time point t1, whereby the first high-voltage opening/closing device 186*a* is closed. When the valve-opening command signal INJ83 or INJ82 is generated, the high-voltage opening/closing command signal A32 becomes the logic level "H", whereby the second high-voltage opening/closing device 186*b* is closed.

FIG. 4(C) is a logic waveform of the low-voltage opening/closing command signal B14 (B32); for example, when the valve-opening command signal INJ81 or INJ84 is generated, the logic level of the first low-voltage opening/closing command signal B14 alternately becomes "H" or "L" during the period from an after-mentioned time point t3 to an after-mentioned time point t4, whereby the first low-voltage opening/closing device 185*a* performs opening/closing operation. When the valve-opening command signal INJ83 or INJ82 is generated, the logic level of the second low-voltage opening/closing command signal B32 alternately becomes "H" or "L", whereby the second low-voltage opening/closing device 185*b* performs opening/closing operation.

In an abnormal condition where due to an abnormality in the voltage boosting circuit unit 170A, the boosted high voltage Vh cannot be obtained, the low-voltage opening/closing command signal B14 (B32) is generated, as indicated by a dotted line 401, and the first low-voltage opening/closing device 185*a* or the second low-voltage opening/closing device 185*b* performs valve-opening operation; the valve-opening command generation periods Tn is prolonged by a time corresponding to the prolonged amount of the valve-opening required time. In the case where the voltage boosting circuit unit 170A operates normally, the low-voltage opening/closing device 185*a* (185*b*) may be closed during the period indicated by the dotted line 401.

FIG. 4(D) is a logic waveform of each of the selective opening/closing command signals CC1 through CC4; when any one of the valve-opening command signals INJ81 through INJ84 is generated, the logic level of any one of the selective opening/closing command signals CC1 through CC4 becomes "H", whereby any one of the selective opening/closing devices 181 through 184 is closed. When the logic level of the selective opening/closing command signal (CC1 through CC4) is set to be "L", as indicated by a dotted line 402, during the period from an after-mentioned time point t2 to the time point t3, the excitation current can rapidly be reduced.

FIG. 4(E) is the waveform of a surge voltage caused when the excitation current for the electromagnetic coil (81 through 84) is cut off by the selective opening/closing device (181 through 184); The magnitude of the surge voltage is limited by the voltage limiting diode in the selective opening/closing device (181 through 184).

FIG. 4(F) represents the waveform of the excitation current Iex for any one of the electromagnetic coils 81 through 84; for example, when the valve-opening command signal INJ81 is generated and the first high-voltage opening/closing device 186*a* and the selective opening/closing device 181 are closed, as explained with reference to FIGS. 4(B) and 4(D), a high voltage, i.e., the boosted high voltage Vh is supplied to the electromagnetic coil 81; when the excitation current Iex rises and reach the setting cutoff current Ia0, the logic level of the high-voltage opening/closing command signal A14 becomes whereby the drive of the first high-voltage opening/closing device 186*a* is stopped.

However, a transistor that functions as the opening/closing device has an opening-circuit response delay time; in particular, in the case where the high-voltage opening/closing device is a field-effect transistor, the opening-circuit response delay time is long and is characterized by changing depending on the temperature. Therefore, even when the drive of the high-voltage opening/closing device is stopped, the excitation current Iex continues rising and starts to decrease after reaching an overshoot current Ip. The rising characteristic of the excitation current Iex undergoes the effect of a resistance-value fluctuation caused by a temperature change in the electromagnetic coil; thus, when the excitation current steeply rises, the overshoot current Ip becomes large even when the opening-circuit response time is the same.

The first peak-hold register 951 or the second peak-hold register 952 monitors and stores this overshoot current, as an actually measured peak current Ip; the microprocessor 111 reads this monitored and stored value and adjusts the value of the setting cutoff current Ia0 by use of a first correction control unit 518, described later with reference to FIG. 5B, so that the actually measured peak current Ip is controlled so as to become a predetermined setting limitation peak current Ip0. After the high-voltage opening/closing device is opened, the excitation current Iex returns to the first commutation diode 189*a* or the second commutation diode 189*b*; then, when the excitation current Iex becomes the setting attenuation current Ib0 or smaller, the selective opening/closing device is opened, as indicated by the dotted line 402, and hence is steeply attenuated during the period from the time point t2 to the time point t3.

The period from the time point t3 to the time point t4 is an opened-valve holding control period; when the excitation current decreases to the setting upward reversal holding current Ie0 or smaller, the first low-voltage opening/closing device 185*a* or the second low-voltage opening/closing device 185*b* is closed, and then the excitation current reverses upward; when the excitation current increases to the setting downward reversal holding current Id0 or larger, the first low-voltage opening/closing device 185*a* or the second low-voltage opening/closing device 185*b* is opened, and then the excitation current reverses downward; the opened-valve holding current Ih is the average current between the setting downward reversal holding current Id0 and the setting upward reversal holding current Ie0.

The microprocessor 111 reads the value of the excitation current Iex during the opened-valve holding control period; when the moving-average value of the excitation current values exceeds the setting upper limit holding current Ic0 or the moving-average value of the excitation current is smaller than the setting lower limit holding current If0, the microprocessor 111 performs abnormality determination. In Embodiment 2, described later, an auxiliary control circuit unit 190B monitors and stored an actually measured maximum holding current Ic and an actually measured minimum holding current If; when the monitored and stored value read by the microprocessor 11 exceeds the setting upper limit holding current Ic0 or is smaller than the setting lower limit holding current If0, the microprocessor 111 performs abnormality determination.

FIG. 4(G) represents the time-measuring period of the actually measured reaching time Tx measured by the first high-speed timer 941 or the second high-speed timer 942; the actually measured reaching time Tx is the time period from a time point when the supply of a high voltage to any one of the electromagnetic coils 81 through 84 is started to a time point when the excitation current Iex reaches the setting cutoff current Ia0. The microprocessor 111 reads the actually measured reaching time Tx, calculates the difference between the actually measured reaching time Tx and the setting target reaching time Tx0, and then performs correction control by use of a second correction control unit 528 or a third correction control unit 938, described later with reference to FIG. 5B and FIG. 9B, respectively.

Next, the operation of the internal combustion engine control system illustrated in FIG. 1 will be explained with reference to a flowchart. FIGS. 5A and 5B are a set of flowcharts for explaining the operation of the vehicle engine control system according to Embodiment 1 of the present invention. In FIG. 5A, the microprocessor 111 starts fuel injection control operation in the step 500. In the step 501, which is a determination step, it is determined whether or not the present operation is the first operation in a circular control flow; in the case where the present operation is the first operation, the result of the determination becomes "YES", and the step 501 is followed by the step 502; in the case where the present operation is the one in a following circular cycle, the result of the determination becomes "NO", and the step 501 is followed by the step 504.

In the step 502, the setting cutoff current Ia0, the setting attenuation current Ib0, the setting downward reversal holding current Id0, and the setting upward reversal holding current Ie0, which are control constants preliminarily stored in the program memory 113A, are transmitted to a predetermined address in the RAM memory 112 and the first setting value registers 9311 through 9314 and the second setting value registers 9321 through 9324 illustrated in FIG. 3. In the step 503, the setting limitation peak current Ip0, the setting target reaching time Tx0, the setting upper limit holding current Ic0, and the setting lower limit holding current If0, which are determination threshold values preliminarily stored in the program memory 113A, are transmitted to a predetermined address in the RAM memory 112.

In the step 504, which is a monitoring timing determination step for the opened-valve holding current, at a timing immediately prior to the end of the valve-opening command generation period for the valve-opening command signal INJn (n=81 through 84) generated in the after-mentioned step 511, the result of the determination becomes "YES", and then the step 504 is followed by the step 505; in the case where the present time is not in the opened-valve holding control period, the result of the determination becomes "NO", and the step 504 is followed by the step 510. In the step 505, the contents of the first present value register 911 or the second present value register 912 are read, and there is calculated the moving-average value of latest data pieces which relate to a single and the same electromagnetic coil (81 through 84) and are read predetermined times.

In the step 506, which is a determination step, it is determined whether or not the present condition is an appropriate condition in which the moving-average value, of the opened-valve holding currents, calculated in the step 505 is in the range between the setting upper limit holding current Ic0 and the setting lower limit holding current If0 stored in the step 503; in the case where the present condition is the appropriate condition, the result of the determination becomes "YES", and then, the step 506 is followed by the step 510; in the case where the present condition is not the appropriate condition, the result of the determination becomes "NO", and then, the step 506 is followed by the step block 507. The step block 507 serves as a first monitoring abnormality processing unit, described later with reference to FIG. 10; the step block 508 consisting of the steps 504 through 507 serves as a first monitoring control unit.

In the step 510, which is a determination step, in response to a crank angle sensor, one of the opening/closing sensors 103, it is determined whether or not the present timing is the timing at which the valve-opening command signal INJn is generated; in the case where the present timing is the timing at which the valve-opening command signal INJn is generated, the result of the determination becomes "YES", and then, the step 510 is followed by the step 511; in the case where the present timing is not the timing at which the valve-opening command signal INJn is generated, the result of the determination becomes "NO", and then, the step 510 is followed by the step 512*a*. In the step 511, the valve-opening command signal INJn (n=81 through 84) for each cylinder is generated. In the step 512*a*, it is determined whether or not there has elapsed a predetermined time, with the elapse of which it is determined that the rapid excitation control time period has elapsed after the valve-opening command signal INJn is generated in the step 511; in the case where the predetermined time has elapsed, the result of the determination becomes "YES", and then, the step 512*a* is followed by the step 512*b*; in the case where the predetermined time has not elapsed, the result of the determination becomes "NO", and then, the step 512*a* is followed by the operation end step 530.

In the step 512*b*, which is a determination step, it is determined whether or not there are read the monitoring storage data pieces stored at the present timing in the first high-speed timer 941 or the second high-speed timer 942 and the first peak-hold register 951 or the second peak-hold register 952; in the case where there are read the monitoring storage data pieces, the result of the determination becomes "YES", and then, the step 512*b* is followed by the step 512*d*; in the case where reading of the monitoring storage data pieces is suspended, the result of the determination becomes "NO", and then, the step 512*b* is followed by the step 512*c*. In the step 512*c*, the reset permission command signal RSTn is stopped, and when the valve-opening command signal INJn (n=81 through 84) is generated thereafter, updating and storing of the monitoring storage data and initialization of the last-time storage data are prohibited; then the step 512*c* is followed by the operation end step 530. In the step 512*d*, the reset permission command signal RSTn prohibited in the step 512*c* is made effective; then, the step 512*d* is followed by the step 513.

In the step 513, the actually measured peak current Ip, which is monitoring storage data stored in the first peak-hold register 951 or the second peak-hold register 952, is read. In the step 514, which is a determination step, the value of the actually measured peak current Ip, read in the step 513, is compared with the value of the setting limitation peak current Ip0 stored in the step 503, and it is determined whether or not the comparison difference is in an appropriate range; in the case where the comparison difference is in an appropriate range, the result of the determination becomes "YES", and then, the step 514 is followed by the step 515; in the case where the comparison difference is not in an appropriate range, the result of the determination becomes "NO", and then, the step 514 is followed by the step block 517.

In the step 515, in response to the difference between the actually measured peak current Ip and the setting limitation peak current Ip0, the setting cutoff current Ia0 is decreased when the actually measured peak current Ip is large or increases when the actually measured peak current Ip is small. The step block 517 serves as a first correction abnormality processing unit, described later with reference to FIG. 10. The step block 518 consisting of the steps 513 through 517 serves as the first correction control unit.

In the step 523 following the step 515 or the step block 517, the value of the actually measured reaching time Tx, which is monitoring storage data stored in the first high-speed timer 941 or the second high-speed timer 942, is read. In the step 524, which is a determination step, the value of the actually measured reaching time Tx, read in the step 523, is compared with the value of the setting target reaching time Tx0 stored in the step 503, and it is determined whether or not the comparison difference is in an appropriate range; in the case where the comparison difference is in an appropriate range, the result of the determination becomes "YES", and then, the step 524 is followed by the step 525; in the case where the comparison difference is not in an appropriate range, the result of the determination becomes "NO", and then, the step 524 is followed by the step block 527.

In the step 525, which is a determination step, in response to the difference between the actually measured reaching time Tx and the setting target reaching time Tx0, it is determined whether or not the valve-opening command generation periods Tn of the valve-opening command signal INJn is adjusted; in the case where the adjustment is not required, the result of the determination becomes "NO", and then the step 525 is followed by the operation end step 530; in the case where the adjustment is implemented, the result of the determination becomes "YES", and then, the step 525 is followed by the step 526.

In the step 526, in the case where the actually measured reaching time Tx is too early, the valve-opening command generation periods Tn is corrected so as to be shortened, and in the case where they actually measured reaching time Tx is too late, the valve-opening command generation periods Tn is corrected so as to be prolonged; then, the step 526 is followed by the operation end step 530. The step block 527 serves as a second correction abnormality processing unit, described later with reference to FIG. 10; the step block 527 is followed by the operation end step 530. The step block 528 consisting of the steps 523 through 526 and the step block 527 serves as the second correction control unit. In the operation end step 530, the other control programs are implemented; then, within a predetermined time, the step 500 is resumed and then the steps 500 through 530 are recurrently implemented.

(3) Gist and Feature of Embodiment 1

As is clear from the foregoing explanation, in order to sequentially drive the fuel-injection electromagnetic valves 108 mounted in the respective cylinders of a multi-cylinder engine, the vehicle engine control system 100A according to Embodiment 1 of the present invention is provided with the input/output interface circuit unit 180 for the electromagnetic coils 81 through 84 that drive the electromagnetic valves, the voltage boosting circuit unit 170A that generates the boosted high voltage Vh for rapidly exciting the electromagnetic coils 81 through 84, and the calculation control circuit unit 110A formed mainly of the microprocessor 111. The input/output interface circuit unit 180 is provided with power supply control opening/closing devices including the first low-voltage opening/closing device 185*a* and the second low-voltage opening/closing device 185*b* that connect each of the first group of the electromagnetic coils 81 and 84 and the second group of the electromagnetic coils 83 and 82, which alternately perform fuel injection, with the vehicle battery 101, the first high-voltage opening/closing device 186*a* and the second high-voltage opening/closing device 186*b* that connect the first group of the electromagnetic coils 81 and 84 and the second group of the electromagnetic coils 83 and 82 with the output of the voltage boosting circuit unit 170A, and respective selective opening/closing devices 181 through 184 separately connected with the electromagnetic coils 81 through 84; and the first current detection resistor 188*a* connected in series with the first group of the electromagnetic coils 81 and 84 and the second current detection resistor 188*b* connected with in series with the second group of the electromagnetic coils 83 and 82. The calculation control circuit unit 110A is provided with the multichannel A/D converter 114*a* that operates at a low speed and collaborates with the microprocessor 111, the multi-channel high-speed A/D converter 115, and the auxiliary control circuit unit 190A.

The low-speed-change analogue sensors 104 including an air flow sensor that detects an intake amount of the engine and a fuel pressure sensor for injection fuel are connected with the multi-channel A/D converter 114*a*; digital conversion data proportional to the signal voltage of each sensor is stored in the buffer memory 114*b* connected with the microprocessor 111 through a bus line; the analogue signal voltages proportional to the respective voltages across the first current detection resistor 188*a* and the second current detection resistor 188*b* are inputted to the high-speed A/D converter 115; respective digital conversion data pieces in the two or more channels obtained through conversion by the high-speed A/D converter are stored in the first present value register 911 and the second present value register 912; the auxiliary control circuit unit 190A is provided with the first numeral value comparators 9211 through 9214 that compare the respective values stored in the first setting value registers 9311 through 9314 with the values stored in the first present value register 911 and the second numeral value comparators 9221 through 9224 that compare the respective values stored in the second setting value registers 9321 through 9324 with the values stored in the second present value register 912, at least one of the pair of the first and second high-speed timers 941 and 942 and the pair of the first and second peak-hole resistors 951 and 952, and the first and second dedicated circuit units 191 and 192.

The first numeral value comparators 9211 through 9214 and the second numeral value comparators 9221 through 9224 compare setting data pieces that are sent from the microprocessor 111, preliminarily stored in the first setting value registers 9311 through 9314 and the second setting value registers 9321 through 9324, and serve as control constants for the excitation currents Iex for the electromagnetic coils 81 through 84 with actually measured data pieces proportional to the present values, of the excitation currents Iex, that are stored in the first and second present value registers 911 and 912; then, the first numeral value comparators 9211 through 9214 and the second numeral value comparators 9221 through 9224 generate the first determination logic outputs CMP11 through CMP14 and the second determination logic outputs CMP21 through CMP24; in response to the signal voltages, from the air flow sensor and the fuel pressure sensor, that are inputted to the multi-channel A/D converter 114*a* and the operation of the crank angle sensor, one of the opening/closing sensors 103, the microprocessor 111 determines the generation timings and the valve-opening command generation periods Tn of the valve-opening command signals INJ81 through INJ84 for the electromagnetic coils 81 through 84; in response to the valve-opening command signals INJ81 through INJ84, the first determination logic outputs CMP11 through CMP14, and the second determination logic outputs CMP21 through CMP24, the first and second dedicated circuit units 191 and 192 generate the first high-voltage opening/closing command signal A14 and the second high-voltage opening/closing command signal A32 for the first high-voltage opening/closing device 186*a* and the second high-voltage opening/closing device 186*b*, the first low-voltage opening/closing command signal B14 and the second low-voltage opening/closing command signal B32 for the first low-voltage opening/closing device 185*a* and the second low-voltage opening/closing device 185*b*, and the opening/closing command signal Drj including the selective opening/closing command signals CC1 through CC4 for the selective opening/closing devices 181 through 184.

The first (second) high-speed timers 941 (942) measures and stores, as the actually measured reaching time Tx, the time from a time point when the valve-opening command signal INJ81 or INJ84 (INJ83 or INJ82) is generated and any one of the first (second) high-voltage opening/closing devices 186*a* (186*b*) and the selective opening/closing devices 181 or 184 (183 or 184) is driven to close to a time point when the excitation current Iex for the electromagnetic coil 81 or 84 (83 or 82) reaches a predetermined setting cutoff current Ia0; the first and second peak-hold registers 951 and 952 store, as the actually measured peak currents Ip, the maximum values of the first and second present value registers 911 and 912 during a period in which the valve-opening command signals INJ81 through INJ84 are generated; the microprocessor 111 is further provided with the correction control units 518, 528, and 938 that each read monitoring storage data, which is the actually measured reaching time Tx or the actually measured peak current Ip, that each monitor the generation state of the rapid excitation current, and that each adjust the setting data for the first setting value registers 9311 through 9314 and the second setting value registers 9321 through 9324 or the valve-opening command generation periods Tn of the valve-opening command signals INJ81 through INJ84 in such a way that the amount of fuel injection by the fuel-injection electromagnetic valve 108 becomes a desired value.

As described above, in a vehicle engine control system according to the present invention, a microprocessor and an auxiliary control circuit unit collaborate with each other so that the control accuracy in fuel injection control can be raised while the rapid control load on the microprocessor is reduced; a configuration according to each of Embodiment 1 and Embodiment 2, described later, demonstrates further characteristics.

As one of the further characteristics, there is demonstrated a characteristic that a low-speed-operation sequential-type multi-channel A/D converter is utilized for 16-point analogue input signals, for example, that do not require high-speed operation, and a high-speed-operation delta/sigma-type A/D converter is utilized for 6-point or less analogue input signals, for example, that are utilized in at least a dedicated application such as detecting the current in the electromagnetic coil for fuel injection and hence the cost of the A/D converter can be suppressed from rising.

As one of the further characteristics, there is demonstrated a characteristic that when the vehicle engine control system controls a gasoline engine, the detection signal of a knock sensor for adjusting the ignition timing of the engine is inputted to a high-speed A/D converter and hence abnormal vibration of the engine can be suppressed and controlled through digital processing.

As one of the further characteristics, there is demonstrated a characteristic that the circuitry including the calculation control circuit unit, the multichannel A/D converter, the high-speed A/D converter, and the auxiliary control circuit unit can be formed as a one-chip or two-chip integrated circuit device and hence a small-size and inexpensive vehicle engine control system can be obtained.

The auxiliary control circuit unit 190A is provided with the first and second peak-hold registers 951 and 952 that store the maximum values of the first and second present value registers 911 and 912 during a period in which the valve-opening command signals INJ81 through INJ84 are generated; the program memory 113A that collaborates with the microprocessor 111 includes a control program that serves as the first correction control unit 518, which is one of the correction control units; the first correction control unit 518 reads and recognizes, as monitoring storage data that has been stored in the first and second peak-hold registers 951 and 952, the actually measured peak current Ip related to the excitation current for any one of the two or more electromagnetic coils 81, 84, 83, and 82 that operate in response to the valve-opening command signals INJ81 through INJ84, adjusts in an increasing or decreasing manner the setting cutoff current Ia0, for the first and second setting value registers 9314 and 9324, that is for determining the closed-circuit period of any one of the first and second high-voltage opening/closing devices 186*a* and 186*b*, in accordance with the amount of the difference between the recognized actually measured peak current Ip and a predetermined setting limitation peak current Ip0, suppresses overshooting fluctuation of the rapid excitation current caused by opening-circuit response delays in the first and second high-voltage opening/closing devices 186*a* and 186*b*, and determines whether or not there exists an abnormality that the monitoring storage data that has been stored in the first and second peak-hold registers 951 and 952 is so large as to exceed the allowable fluctuation range of the setting limitation peak current Ip0 or too small.

As described above, with regard to claim 2 of the present invention, the setting cutoff currents stored in the first and second setting value registers are adjusted in such a way that the values of the actually measured peak currents stored in the first and peak-hold registers become equal to predetermined target overshoot currents.

Therefore, there is demonstrated a characteristic that even when the rising gradient of the excitation current fluctuates due to a temperature change in the electromagnetic coil, or even when the opening-circuit response delay time of the high-voltage opening/closing device fluctuates due to a change in the ambient temperature, the target setting limitation peak current can be obtained by feedback-adjusting the cutoff timing or the excitation current while monitoring the overshoot value of the excitation current, whereby the rapid excitation characteristic stabilizes and hence high-accuracy fuel injection can be implemented. Embodiment 2 demonstrates the same characteristic.

Even though in order to adjust the peak current value in an increasing and decreasing manner, the boosted high voltage generated by the voltage boosting circuit unit is adjusted, the maximum excitation current cannot be obtained unless the setting cutoff current is adjusted; even though the boosted high voltage is not adjusted, the target maximum excitation current can be obtained by correcting the setting cutoff current.

The auxiliary control circuit unit 190A is provided with the first and second high-speed timers 941 and 942 that each measure and store the actually measured reaching time Tx related to the commanded excitation current for any one of the electromagnetic coils 81 through 84 during a period in which the valve-opening command signals INJ81 through INJ84 are generated; the program memory 113A that collaborates with the microprocessor 111 includes a control program that serves as the second correction control unit 528, which is one of the correction control units; the second correction control unit 528 reads the actually measured reaching time Tx, which is the monitoring storage data monitored and stored by the first and second high-speed timers 941 and 942, and adjusts in an increasing and decreasing manner the valve-opening command generation periods Tn of the valve-opening command signals INJ81 through INJ84 in accordance with the amount of the difference between a predetermined setting target reaching time Tx0 and the actually measured reaching time Tx. In the case where the rapid excitation current for the electromagnetic coil (81 through 84) rises faster than it expected, the second correction control unit 528 adjusts and shortens the valve-opening command generation period Tn, and in the case where the rapid excitation current for the electromagnetic coil (81 through 84) rises slower than it expected, the second correction control unit 528 adjusts and prolongs the valve-opening command generation period Tn, so that the actual valve opening period is corrected so as to become constant; the second correction control unit 528 determines whether or not there exists an abnormality that the actually measured reaching time Tx, which is the monitoring storage data that has been stored in the first and second high-speed timers 941 and 942 is so long as to exceed the allowable fluctuation range of the setting target reaching time Tx0 or too short.

As described above, with regard to claim 3 of the present invention, the valve-opening command generation period is corrected in accordance with the amount of the difference between the predetermined setting target reaching time and the actually measured reaching time of the rapid excitation current, stored in each of the first and second high-speed timers 941 and 942.

Therefore, there is demonstrated a characteristic that a fluctuation in the fuel injection amount, which is caused by a fluctuation, in the rising characteristic of the excitation current, that is caused when the resistance value of the electromagnetic coil fluctuates due to a temperature change or when the resistance values of the wiring leads vary, is corrected so that high-accuracy fuel injection can be implemented.

The microprocessor can perform reading and correction control of the first or the second high-speed timer during a single period in which the valve-opening command signal is generated one time; thus, in the case where the engine rotation speed is extremely high, it is made possible to adjust the generation period of the valve-opening command signal based on the last-time monitoring storage data in the first or the second high-speed timer, at the latest when the next-cycle valve-opening command signal is generated.

The input/output interface circuit unit 180 is provided with the first and second reverse-flow prevention diodes 187*a* and 187*b* that are connected in series with the first and second low-voltage opening/closing devices 185*a* and 185*b*, respectively, that are separately connected between the vehicle battery 101 and the first group of electromagnetic coils 81 and 84 and between the vehicle battery 101 and the second group of electromagnetic coils 83 and 82; the first and second high-voltage opening/closing devices 186*a* and 186*b* that are separately connected between the high-voltage power source generated by the voltage boosting circuit unit 170A and the first group of electromagnetic coils 81 and 84 and between the high-voltage power source and the second group of electromagnetic coils 83 and 82, respectively; the first group and second group of selective opening/closing devices 181, 184, 183, and 182 that are separately connected in series with the respective electromagnetic coils 81 through 84 and whose conduction timings and conduction periods are set by the microprocessor 111; the first current detection resistor 188*a* connected in series and commonly with the first group of electromagnetic coils 81 and 84; the second current detection resistor 188*b* connected in series and commonly with the second group of electromagnetic coils 83 and 82; the first commutation diode 189*a* connected in parallel with the series circuit consisting of the first group of electromagnetic coils 81 and 84, the first group of selective opening/closing devices 181 and 184, and the first current detection resistor 188*a*; and the second commutation diode 189*b* connected in parallel with the series circuit consisting of the second group of electromagnetic coils 83 and 82, the second group of selective opening/closing devices 183 and 182, and the second current detection resistor 188*b*. The first and second high-voltage opening/closing devices 186*a* and 186*b* perform the rapid excitation control of the first group of electromagnetic coils 81 and 84 and the second group of electromagnetic coils 83 and 82, respectively; the first and second low-voltage opening/closing devices 185*a* and 185*b* perform the opened-valve holding control of the first group of electromagnetic coils 81 and 84 and the second group of electromagnetic coils 83 and 82, respectively.

The rapid excitation control is implemented in the following manner: until the value of the first present value register 911 (the second present value register 912) provided in the auxiliary control circuit unit 190A reaches the setting cutoff current Ia0, which is the setting value of the first setting value register 9314 (the second setting value register 9324), the first high-voltage opening/closing device 186*a* (the second high-voltage opening/closing device 186*b*) supplies a high voltage to the electromagnetic coils 81 and 84 (the electromagnetic coils 82 and 83); after the value of the first present value register 911 (the second present value register 912) reaches the setting cutoff current Ia0, the vehicle battery 101 and the first low-voltage opening/closing device 185*a* (the second low-voltage opening/closing device 185*b*) perform sustainable power supply or the first low-voltage opening/closing device 185*a* (the second low-voltage opening/closing device 185*b*) is kept opened and the excitation current Iex is commutated and attenuated through the commutation diode 189*a* (189*b*) until the value of the first present value register 911 (the second present value register 912) is attenuated to the setting attenuation current Ib0, which is the setting value for the first setting value register 9313 (the second setting value register 9323). The opened-valve holding control is implemented in the following manner: when the value of the first present value register 911 (the second present value register 912) provided in the auxiliary control circuit unit 190A becomes the same as or smaller than the setting upward reversal holding current Ie0, which is the setting value of the first setting value register 9311 (the second setting value register 9321), the first low-voltage opening/closing device 185*a* (the second low-voltage opening/closing device 185*b*) becomes conductive; when the value of the first present value register 911 (the second present value register 912) provided in the auxiliary control circuit unit 190A becomes the same as or larger than the setting downward reversal holding current Id0, which is the setting value of the first setting value register 9312 (the second setting value register 9322), the first low-voltage opening/closing device 185*a* (the second low-voltage opening/closing device 185*b*) becomes nonconductive, and the first group selective opening/closing devices 181 and 184 and the second selective opening/closing devices 183 and 182 are kept conductive during a period in which the valve-opening command signals INJ1 through INJ4 are generated or the first and second selective opening/closing devices 181, 184, 183, and 182 become nonconductive during a transient period in which the excitation currents for the electromagnetic coils 81 through 84 fall from the setting attenuation current Ib0 to the setting downward reversal holding current Id0; it is selected based on the valve-opening command signals INJ1 through INJ4 which one of the first low-voltage opening/closing device 185*ba* and the second low-voltage opening/closing device 185*b* becomes conductive, which one of the first high-voltage opening/closing device 186*a* and the second high-voltage opening/closing device 186*b* becomes conductive, and which one of the selective opening/closing devices 181, 184, 183, and 182 becomes conductive.

As described above, with regard to claim 7 of the present invention, rapid excitation control and opened-valve holding control are applied to the electromagnetic coils divided into the first group and the second group, by use of respective four setting value registers and respective four numeral value comparators.

Therefore, the microprocessor can perform opening/closing control of the power supply control opening/closing devices only by preliminarily storing controlling setting values in the respective setting registers; thus, there is demonstrated a characteristic that the microprocessor can readily change the controlling setting values. Embodiment 2, described later, demonstrates the same characteristic.

The program memory 113A that collaborates with the microprocessor 111 includes a control program that serves as the first monitoring control unit 508; the first monitoring control unit 508 reads the value of the first present value register 911 or the second present value register 912 during the opened-valve holding control period and determines whether or not there exists an abnormality that the moving-average value of the read opened-valve holding current Ih is larger than a predetermined setting upper limit holding current Ic0 or smaller than a predetermined setting lower limit holding current If0.

As described above, with regard to claim 8 of the present invention, opened-valve holding control is performed by the auxiliary control circuit unit; based on the moving-average value of the read values of the first or second present value register, the microprocessor monitors whether or not the opened-valve holding control is being performed normally.

Accordingly, even when the present value of the holding current pulsates, the holding current is read two or more times during a one-time valve-opening command generation period in the case where the engine rotation speed is low, and the holding current is read over two or more valve-opening command generation periods in the case where the engine rotation speed is high, so that based on the holding current smoothed with the moving-average value of data pieces that are read two or more times, it is determined whether or not an abnormality exists; thus, there is demonstrated a characteristic that the rapid control load on the microprocessor is reduced and the microprocessor can readily determine whether or not there exists an abnormality in the holding current control performed by the auxiliary control circuit unit.

Embodiment 2

(1) Detailed Description of Configuration

Figure 6:
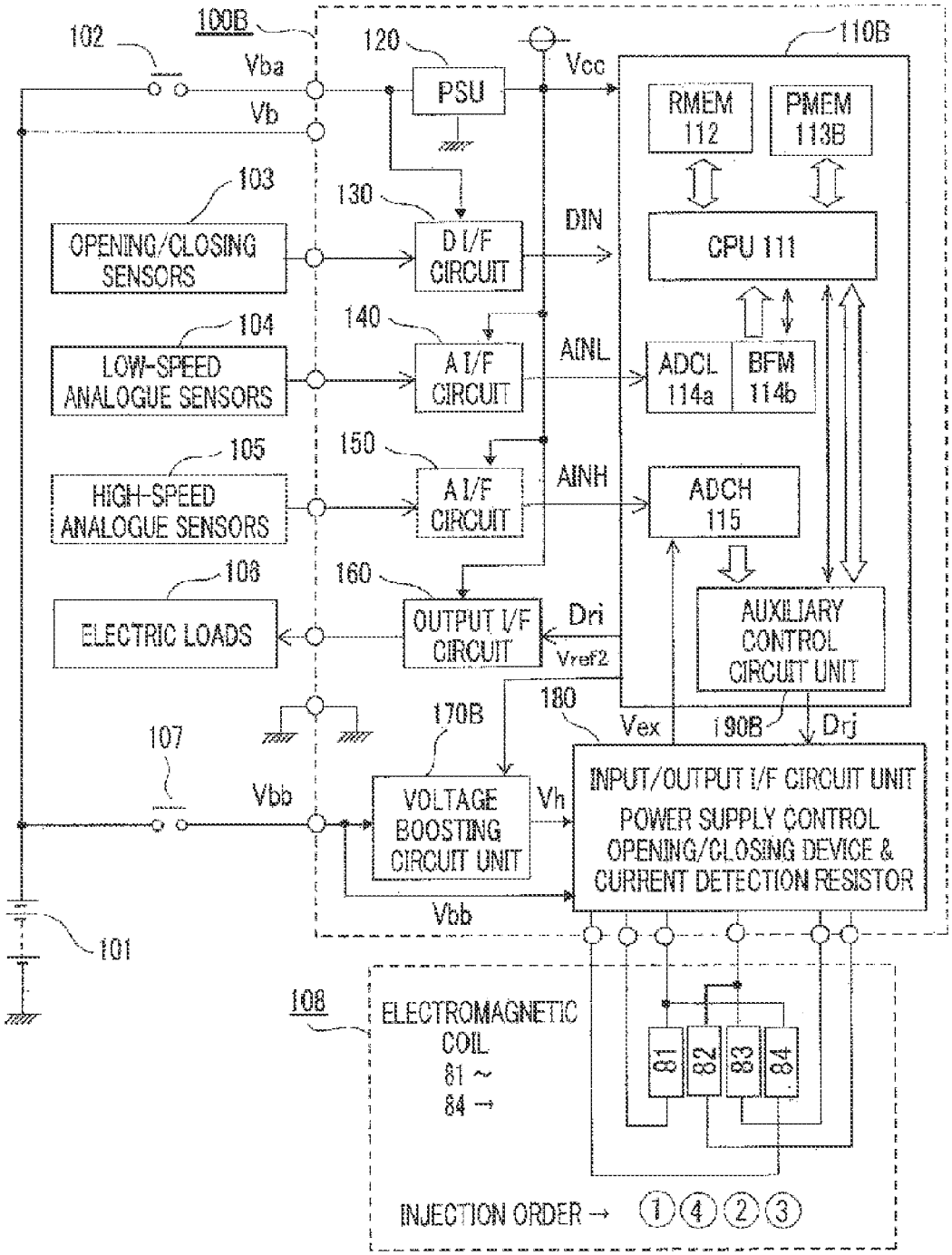
FIG. 6 is a block diagram illustrating the overall configuration of a vehicle engine control system according to Embodiment 2 of the present invention.

Next, there will be explained a vehicle engine control system according to Embodiment 2 of the present invention. FIG. 6 is a block diagram illustrating the overall configuration of a vehicle engine control system according to Embodiment 2 of the present invention. Hereinafter, the difference between a vehicle engine control system according to Embodiment 2 and the vehicle engine control system according to Embodiment 1, illustrated in FIG. 1, will mainly be explained.

The main differences between a vehicle engine control system 100B according to Embodiment 2 and the vehicle engine control system 100A according to Embodiment 1 are that in the vehicle engine control system 100B, a microprocessor sets in a variable manner the boosted high voltage Vh generated by a voltage boosting circuit unit 170B and hence a third correction control unit 938 is utilized instead of the second correction control unit 528 and that in the vehicle engine control system 100B, a register that monitors and stores the maximum value and the minimum value of the opened-valve holding current Ih is added to an auxiliary control circuit unit 190B and hence a second monitoring control unit 908 is utilized instead of the first monitoring control unit 508; in each of the drawings, the same reference characters denote the same or similar portions.

In FIG. 6, the vehicle engine control system 100B is configured mainly with a calculation control circuit unit 110B, an input/output interface circuit unit 180, and a voltage boosting circuit unit 170B. As is the case with FIG. 1, the vehicle battery 101, the control power source switch 102, the opening/closing sensors 103, the analogue sensors 104, the analogue sensors 105, the electric loads 106, the load power source switch 107, and the fuel-injection electromagnetic valve 108 including the electromagnetic coils 81 through 84 are connected with the outside of the vehicle engine control system 100B; the battery voltage Vb, the main power source voltage vba, and the load power source voltage vbb are supplied to the vehicle engine control system 100B.

As is the case with FIG. 1, the constant voltage power source 120, the opening/closing input interface circuit 130, the low-speed analogue input interface circuit 140, the high-speed analogue input interface circuit 150, and the output interface circuit 160 are provided in the vehicle engine control system 100B; however, in the case where as the analogue sensors 105, no analogue sensor for a high-speed change is utilized, the high-speed analogue input interface circuit 150 is not required.

As is the case with FIG. 1, the calculation control circuit unit 110B is configured with the microprocessor 111, the RAM memory 112 for calculation processing, the program memory 113B, the low-speed-operation multichannel A/D converter 114*a*, the buffer memory 114*b*, the high-speed A/D converter 115, and the auxiliary control circuit unit 190B. The input/output interface circuit unit 180 is the same as that illustrated in FIG. 1; however, the voltage boosting circuit unit 170B and the auxiliary control circuit unit 190B will be explained in detail with reference to FIGS. 7 and 8, respectively.

Figure 7:
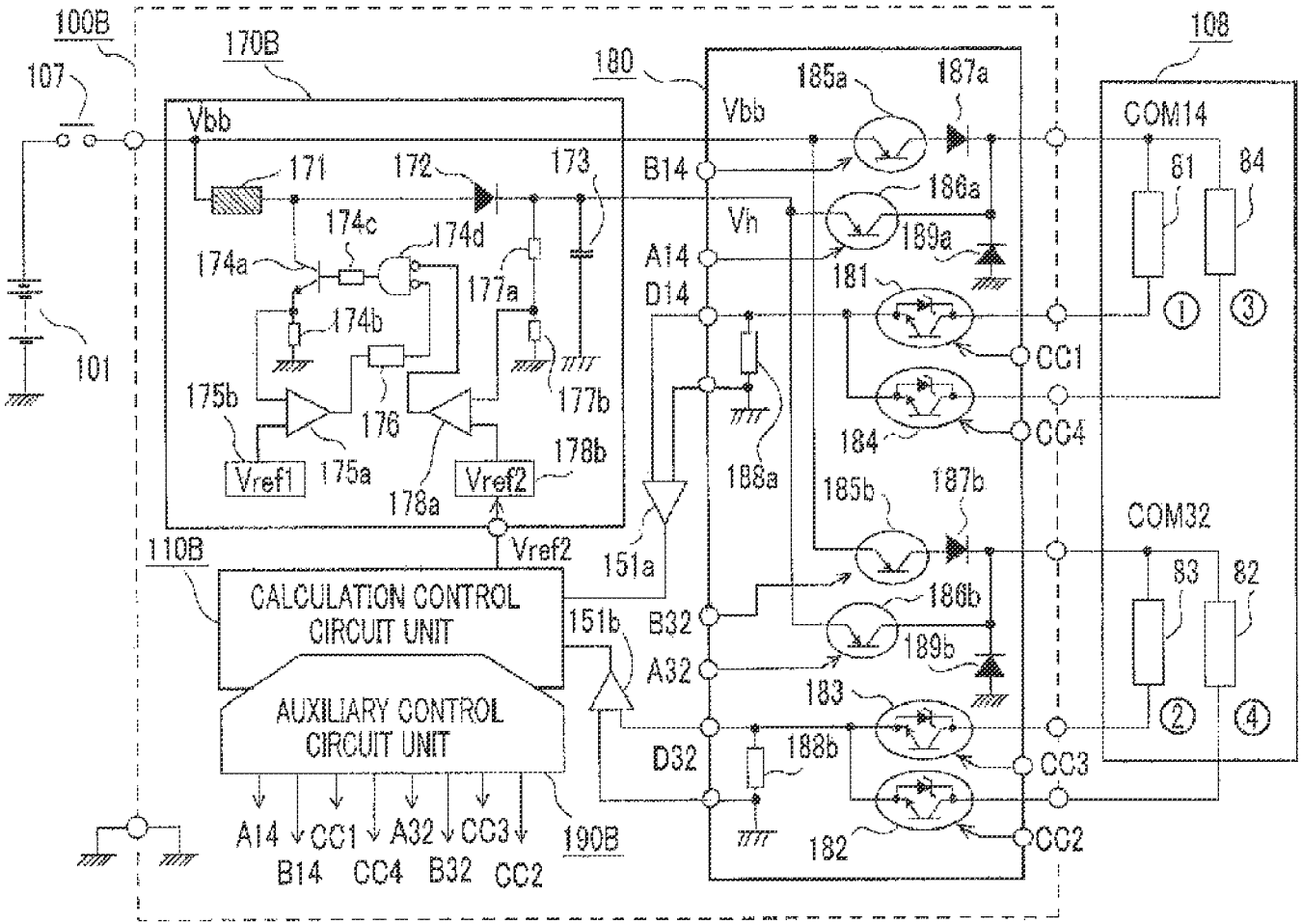
FIG. 7 is a block diagram illustrating the detail of part of a control circuit in a vehicle engine control system according to Embodiment 2 of the present invention.

Next, part of the control circuit in the vehicle engine control system illustrated in FIG. 6 will be explained. FIG. 7 is a block diagram illustrating the detail of part of the control circuit in a vehicle engine control system according to Embodiment 2 of the present invention. In FIG. 7, the voltage boosting circuit unit 170B is configured in the same manner as the voltage boosting circuit unit 170A in FIG. 2, and is provided with the induction device 171, the charging diode 172, the high-voltage capacitor 173, the voltage boosting opening/closing device 174*a*, the current detection resistor 174*b*, the first comparator 175*a*, the first threshold voltage Vref1, the second comparator 178*a*, and the second threshold voltage Vref2; the calculation control circuit unit 110B can set in a changeable manner the second threshold voltage Vref2 for determining the boosted high voltage Vh.

In a simple method for setting the second threshold voltage Vref2 in a changeable manner, the control power-source voltage Vcc is divided by a positive-side division resistor and a negative-side division resistor; a plurality of adjustment resistors are provided in parallel with the negative-side division resistor; respective opening/closing devices are connected in series with the adjustment resistors; and part or all of the opening/closing devices are opened or closed based on commands from the microprocessor 111. For example, when 3 pieces each of adjustment resistors and opening/closing devices are utilized, the second threshold voltage Vref2, adjusted in eight steps, can be obtained. As a common method for setting the second threshold voltage Vref2 in a changeable manner, the microprocessor 111 generates a constant-cycle pulse signal having an ON-time duration proportional to the value of the second threshold voltage Vref2 and the pulse signal is smoothed by a filter circuit utilizing a resistor and a capacitor, so that an analogue signal voltage proportional to the value of the second threshold voltage Vref2 can be generated.

Figure 8:
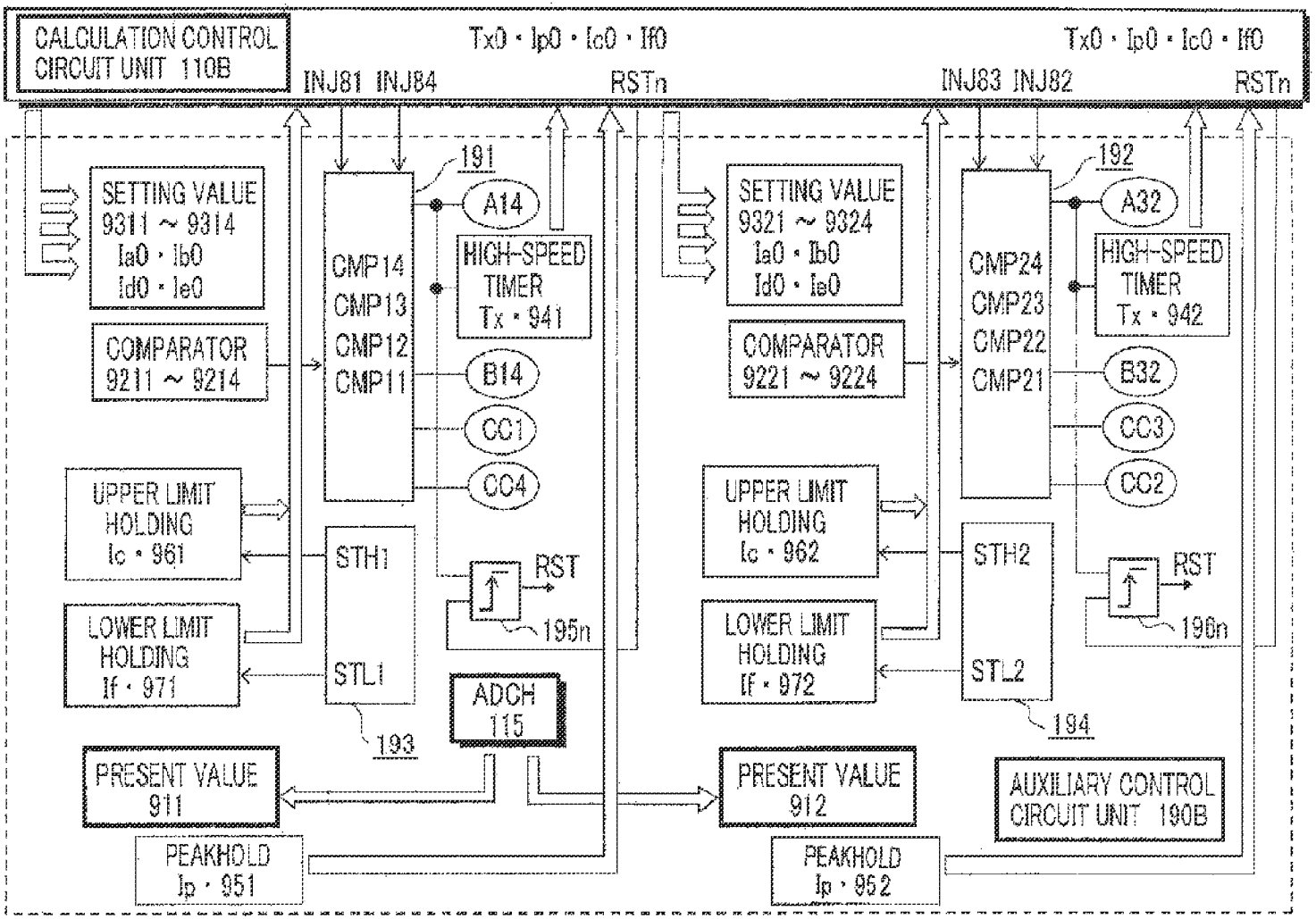
FIG. 8 is a block diagram illustrating the detail of an auxiliary control circuit unit in a vehicle engine control system according to Embodiment 2 of the present invention.

Next, the details of the auxiliary control circuit unit of the vehicle engine control system illustrated in FIG. 6 will be explained. FIG. 8 is a block diagram illustrating the detail of the auxiliary control circuit unit in the vehicle engine control system according to Embodiment 2 of the present invention. In FIG. 8, as is the case with the auxiliary control circuit unit 190A in FIG. 3, the auxiliary control circuit unit 190B is provided with the first and second present value registers 911 and 912, the first numeral value comparators 9211 through 9214 and the second numeral value comparators 9221 through 9224, the first setting value registers 9311 through 9314 and the second setting value registers 9321 through 9324, the first and second high-speed timers 941 and 942, the first and second peak-hold registers 951 and 952, the first and second dedicated circuit units 191 and 192, and the first and second gate circuits 195*n* and 196*n*; based on the valve-opening command signals INJn (n=81 through 84) generated by the calculation control circuit unit 110B, the first numeral value comparators 9211 through 9214 and the second numeral value comparators 9221 through 9224, and the first determination logic outputs CMP11 through CMP14 and the second determination logic outputs CMP21 through CMP24, the opening/closing command signals Drj including the first and second high-voltage opening/closing command signals A14 and A32, the first and second low-voltage opening/closing command signals B14 and B32, and the selective opening/closing command signals CC1 through CC4 are generated.

A first and second upper-limit hold registers 961 and 962 newly added to the auxiliary control circuit unit 190B read the values of the first and present value registers 911 and 912, respectively, during an opened-valve holding control period; in the case where the present reading value is larger than the past reading and storage value, each of the first and second upper-limit hold registers 961 and 962 updates the past one so as to store, as an actually measured maximum hold current Ic, the maximum value obtained after the reading has been started. A first and second lower-limit hold registers 971 and 972 newly added to the auxiliary control circuit unit 190B read the values of the first and present value registers 911 and 912, respectively, during an opened-valve holding control period; in the case where the present reading value is smaller than the past reading and storage value, each of the first and second upper-limit hold registers 971 and 972 updates the past one so as to store, as an actually measured minimum hold current If, the minimum value obtained after the reading has been started.

A first additional dedicated circuit unit 193 (a second additional dedicated circuit unit 194) newly added to the auxiliary control circuit unit 190B detects the period between the time point t3 and the time point t4, which is the opened-valve holding control period in FIG. 4(F), and commands the first upper-limit hold register 961 (the second upper-limit hold register 962) and the first lower-limit hold register 971 (the second lower-limit hold register 972) to perform monitoring storage operation based on an upper-limit hold command STH1 (STH2) and a lower-limit hold command STL1 (STL2), respectively.

(2) Detailed Description of Operation

Figure 9A:
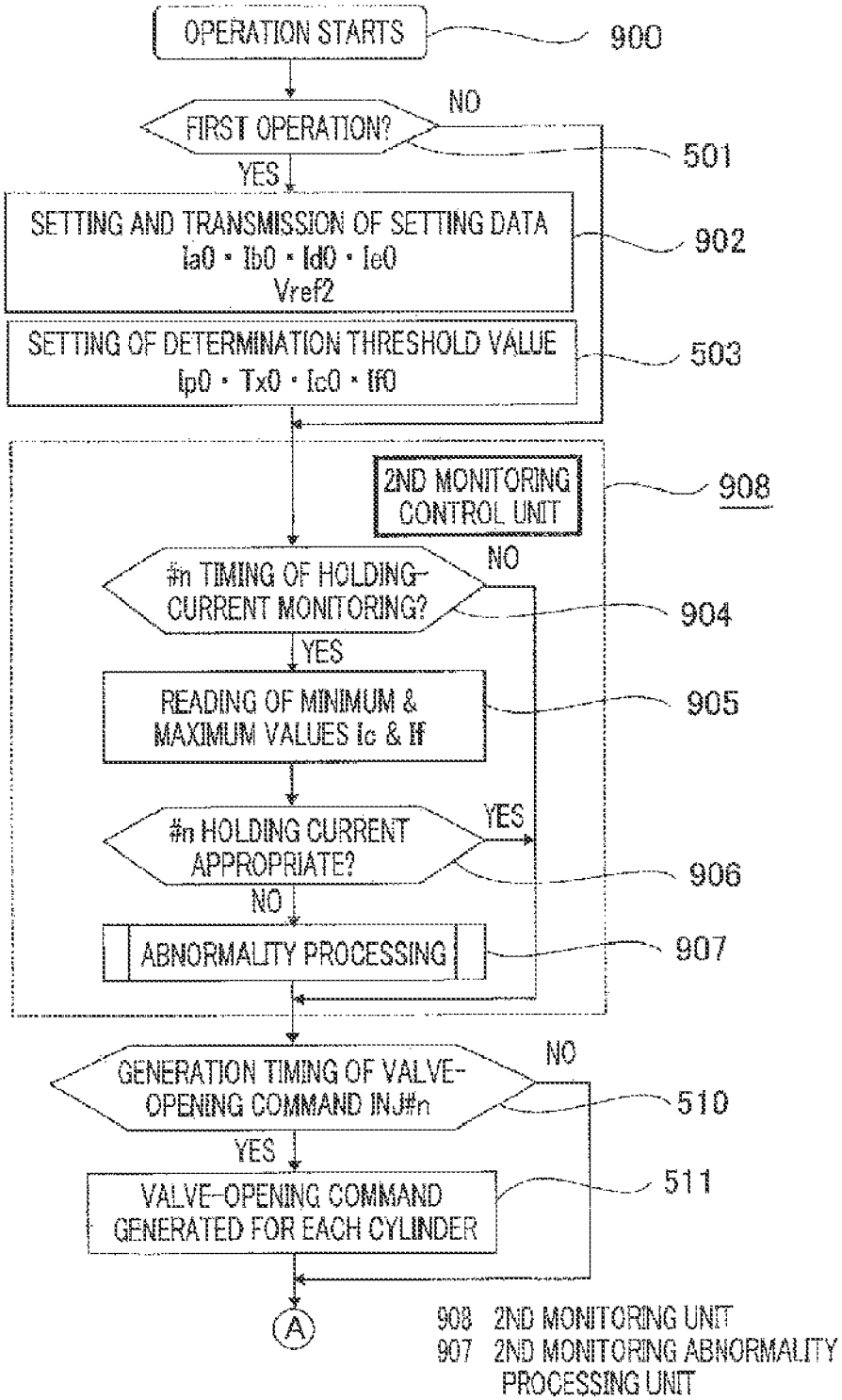
FIGS. 9A and 9B are a set of flowcharts for explaining the operation of a vehicle engine control system according to Embodiment 2 of the present invention.
Figure 9B:
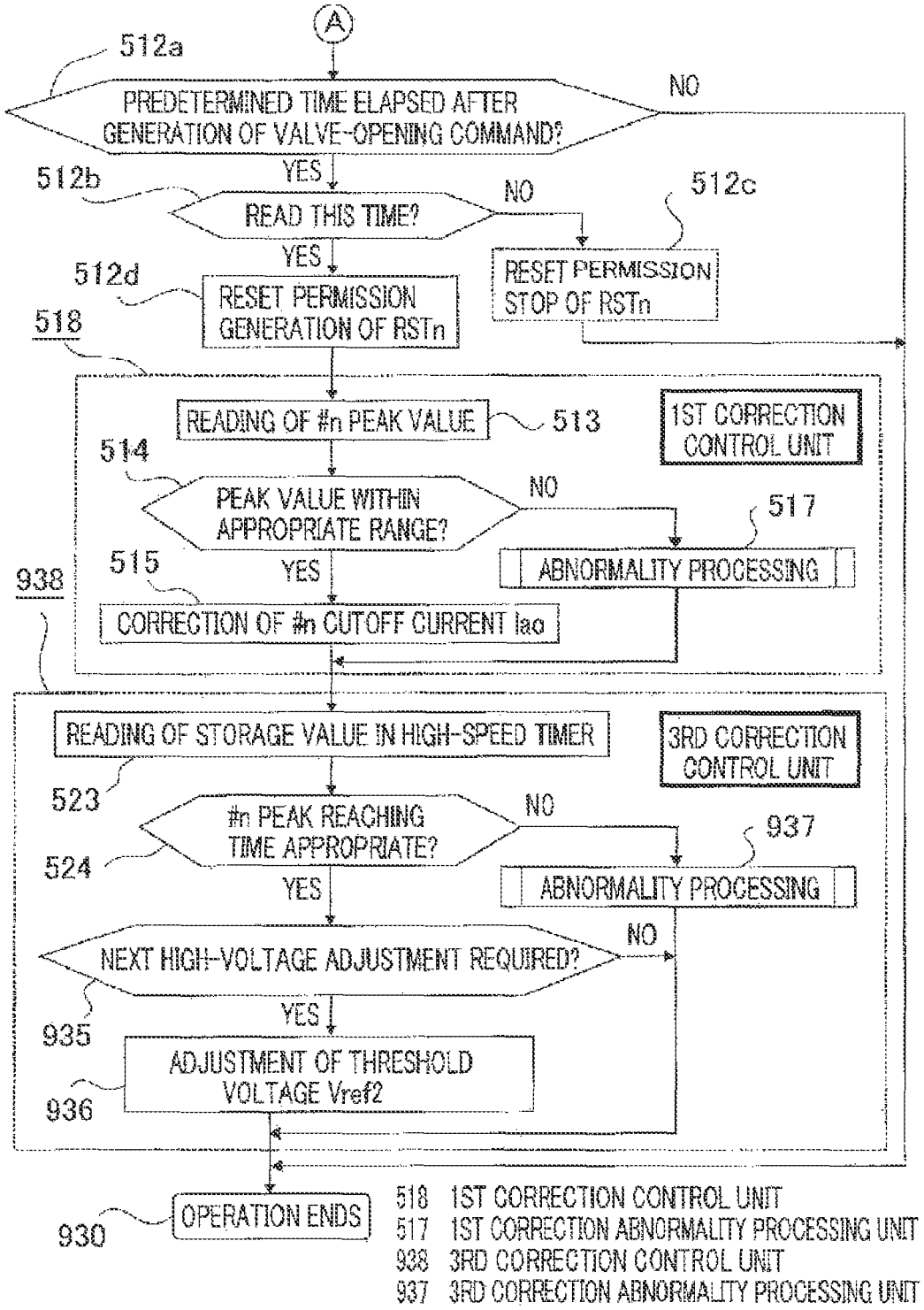

Hereinafter, there will be explained the operation of the vehicle engine control system, according to Embodiment 2 of the present invention, that is configured as illustrated in FIG. 6. FIGS. 9A and 9B are a set of flowcharts for explaining the operation of the vehicle engine control system according to Embodiment 2 of the present invention. The timing chart, represented in FIG. 4, for explaining the operation applies also to Embodiment 2; thus the explanation therefor will be omitted. At first, in FIG. 6, when an unillustrated power switch is closed, the control power source switch 102, which is the output contact of the power supply relay, is closed, whereby the main power source voltage vba is applied to the vehicle engine control system 100B. As a result, the constant voltage power source 120 generates a control power source Vcc of, for example, DC 5V and then the microprocessor 111 starts its control operation.

In response to the operation statuses of the opening/closing sensors 103, the low-speed-change analogue sensors 104, and the high-speed-change analogue sensors 105 and the contents of the control program stored in the nonvolatile program memory 113B, the microprocessor 111 energizes the load power supply relay so as to close the load power source switch 107; concurrently, the microprocessor 111 generates the load-driving command signals Dri to the electric loads 106 and the opening/closing command signals Drj to the electromagnetic coils 81 through 84, which are the specific electric loads among the electric loads 106. On the other hand, the voltage boosting circuit unit 170B charges the high-voltage capacitor 173 with a high voltage when the voltage boosting opening/closing device 174*a* intermittently opens and closes.

Next, FIGS. 9A and 9B will be explained; differences between FIGS. 9A/9B and FIGS. 5A/5B will mainly be explained. In FIGS. 9A and 9B, the steps in which the same operation items as those in FIGS. 5A and 5B are performed are designated by reference numerals in the 500s, and the steps in which different operation items are performed are designated by reference numerals in the 900s. In FIG. 9A, the microprocessor 111 starts fuel injection control operation in the step 900. In the step 501, which is a determination step, it is determined, as described above, whether or not the present operation is the first operation in a circular control flow; in the case where the present operation is the first operation, the result of the determination becomes "YES", and the step 501 is followed by the step 902; in the case where the present operation is the one in a following circular cycle, the result of the determination becomes "NO", and the step 501 is followed by the step 904.

In the step 902, the setting cutoff current Ia0, the setting attenuation current Ib0, the setting downward reversal holding current Id0, and the setting upward reversal holding current Ie0, which are control constants preliminarily stored in the program memory 113B, and the value of the second threshold voltage Vref2 for determining the boosted high voltage Vh are transmitted to a predetermined address in the RAM memory 112 and to the first setting value registers 9311 through 9314 and the second setting value registers 9321 through 9324 illustrated in FIG. 8. In the step 503, as described above, the setting limitation peak current Ip0, the setting target reaching time Tx0, the setting upper limit holding current Ic0, and the setting lower limit holding current If0, which are determination threshold values preliminarily stored in the program memory 113B, are transmitted to a predetermined address in the RAM memory 112.

In the step 904, which is a monitoring timing determination step related to the maximum and minimum values of an opened-valve holding current, at a timing immediately prior to or immediately after the end of the valve-opening command generation period for the valve-opening command signal INJn (n=81 through 84) generated in the after-mentioned step 511, the result of the determination becomes "YES", and then the step 904 is followed by the step 905; in the case where at a timing before the end of the opened-valve holding control period, the result of the determination becomes "NO", and the step 904 is followed by the step 510. In the step 905, the contents of the first upper-limit hold register 961 or the second upper-limit hold register 962 are read so as to obtain the value of the actually measured maximum holding current Ic, and the contents of the first lower-limit hold register 971 or the second lower-limit hold register 972 are read so as to obtain the value of the actually measured minimum holding current If.

In the step 906, which is a determination step, it is determined whether or not the present condition is an appropriate condition in which the actually measured maximum holding current Ic and the actually measured minimum holding current If obtained in the step 905 are in the range between the setting upper limit holding current Ic0 and the setting lower limit holding current If0 stored in the step 503; in the case where the present condition is an appropriate condition, the result of the determination becomes "YES", and then, the step 906 is followed by the step 510; in the case where the present condition is not an appropriate condition, the result of the determination becomes "NO", and then, the step 906 is followed by the step block 907. The step block 907 serves as a second monitoring abnormality processing unit, described later with reference to FIG. 10; the step block 908 consisting of the steps 904 through 907 serves as a second monitoring control unit.

Figure 5A:
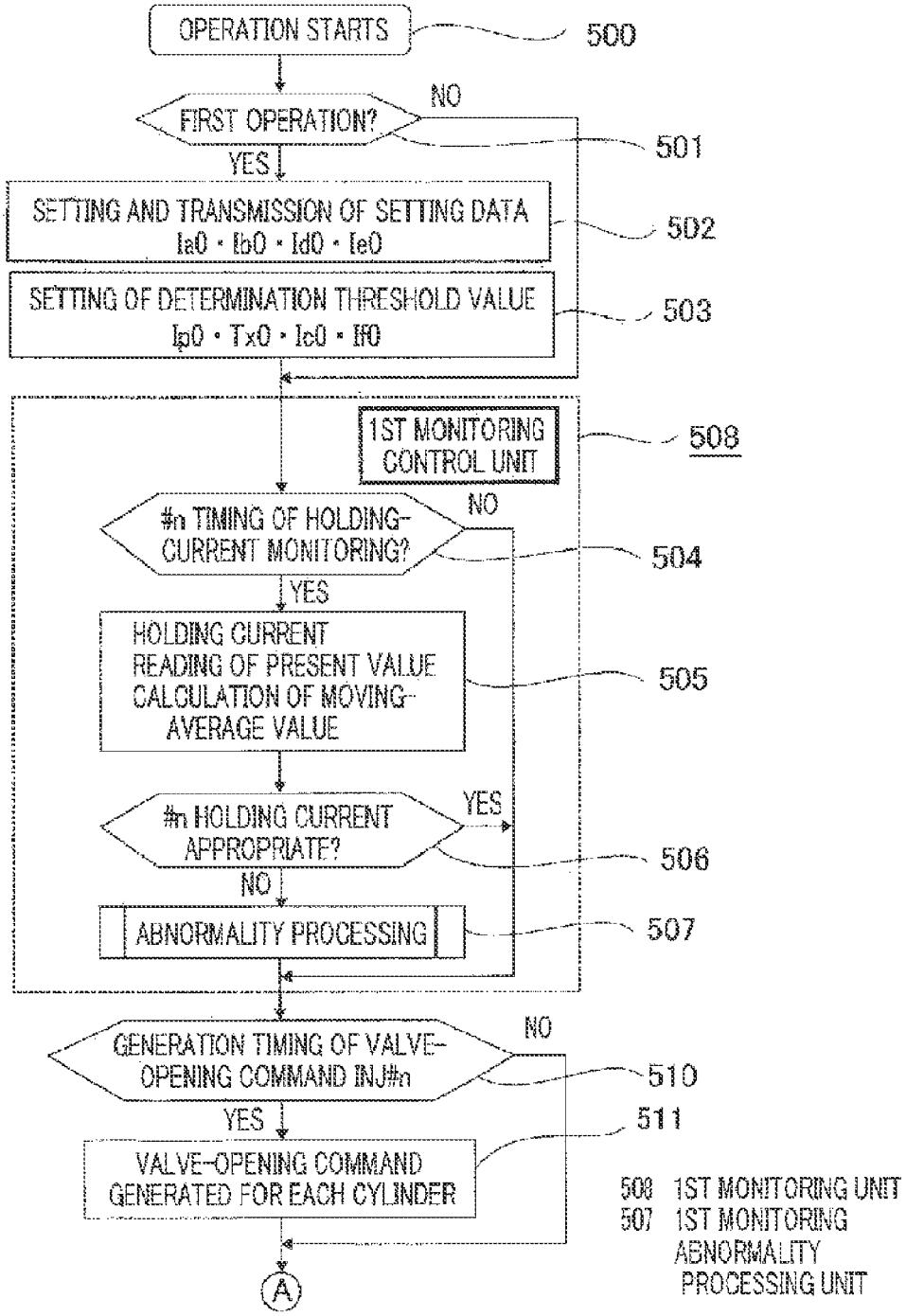
FIGS. 5A and 5B are a set of flowcharts for explaining the operation of a vehicle engine control system according to Embodiment 1 of the present invention.
Figure 5B:
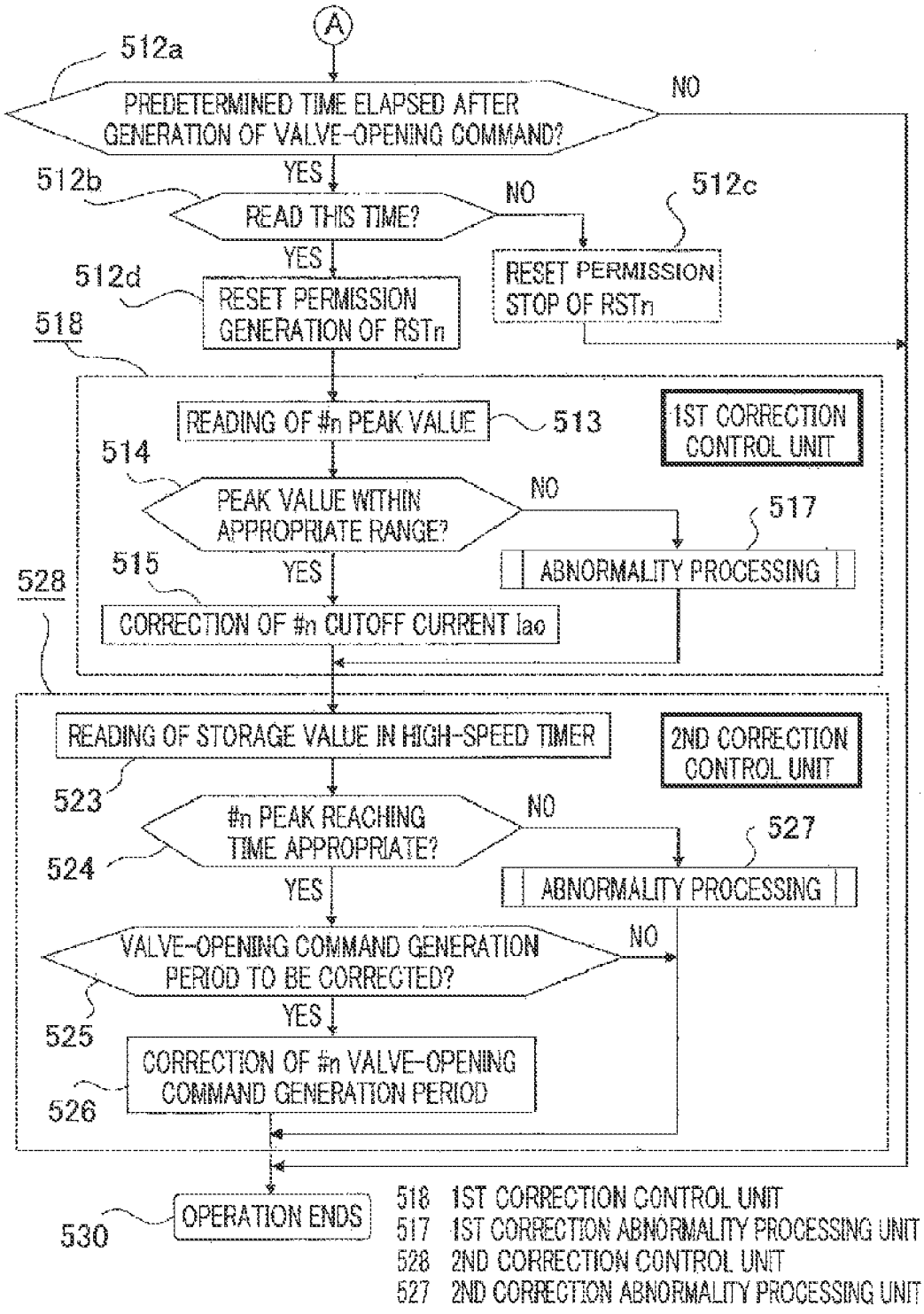

In the process from the step S510 to the step S518, the same processing as in FIGS. 5A and 5B is performed. In the step 523 following the step 515 or the step block 517, as described above, the value of the actually measured reaching time Tx, which is monitoring storage data stored in the first high-speed timer 941 or the second high-speed timer 942, is read. In the step 524, which is a determination step, the value of the actually measured reaching time Tx, read in the step 523, is compared with the value of the setting target reaching time Tx0 stored in the step 503, and it is determined whether or not the comparison difference is in an appropriate range; in the case where the comparison difference is in an appropriate range, the result of the determination becomes "YES", and then, the step 524 is followed by the step 935; in the case where the comparison difference is not in an appropriate range, the result of the determination becomes "NO", and then, the step 524 is followed by the step block 937.

In the step 935, which is a determination step, in response to the difference between the actually measured reaching time Tx and the setting target reaching time Tx0, it is determined whether or not the boosted high voltage Vh is adjusted; in the case where the adjustment is not required, the result of the determination becomes "NO", and then the step 935 is followed by the operation end step 930; in the case where the adjustment is implemented, the result of the determination becomes "YES", and then, the step 935 is followed by the step 936.

In the step 936, in the case where the actually measured reaching time Tx is too early, the second threshold voltage Vref2 is lowered so that the boosted high voltage Vh is lowered next time and thereafter; in the case where the actually measured reaching time Tx is too late, the second threshold voltage Vref2 is raised so that the boosted high voltage Vh is raised next time and thereafter; then, the step 936 is followed by the operation end step 930. The microprocessor 111 generates a pulse-width modulation signal having a duty (the ratio of the ON time to the ON/OFF cycle) proportional to the value of the second threshold voltage Vref2 and the pulse signal is smoothed by a filter circuit so that the second setting threshold voltage Vref2 can be re-generated.

The step block 937 serves as a third correction abnormality processing unit, described later with reference to FIG. 10; the step block 937 is followed by the operation end step 930. The step block 938 consisting of the steps 523, 524, 935, and 936 and the step block 937 serves as the third correction control unit. In the operation end step 930, the other control programs are implemented; then, within a predetermined time, the step 900 is resumed and then a series of operation items from the step 900 to the step 930 is recurrently implemented.

Figure 10:
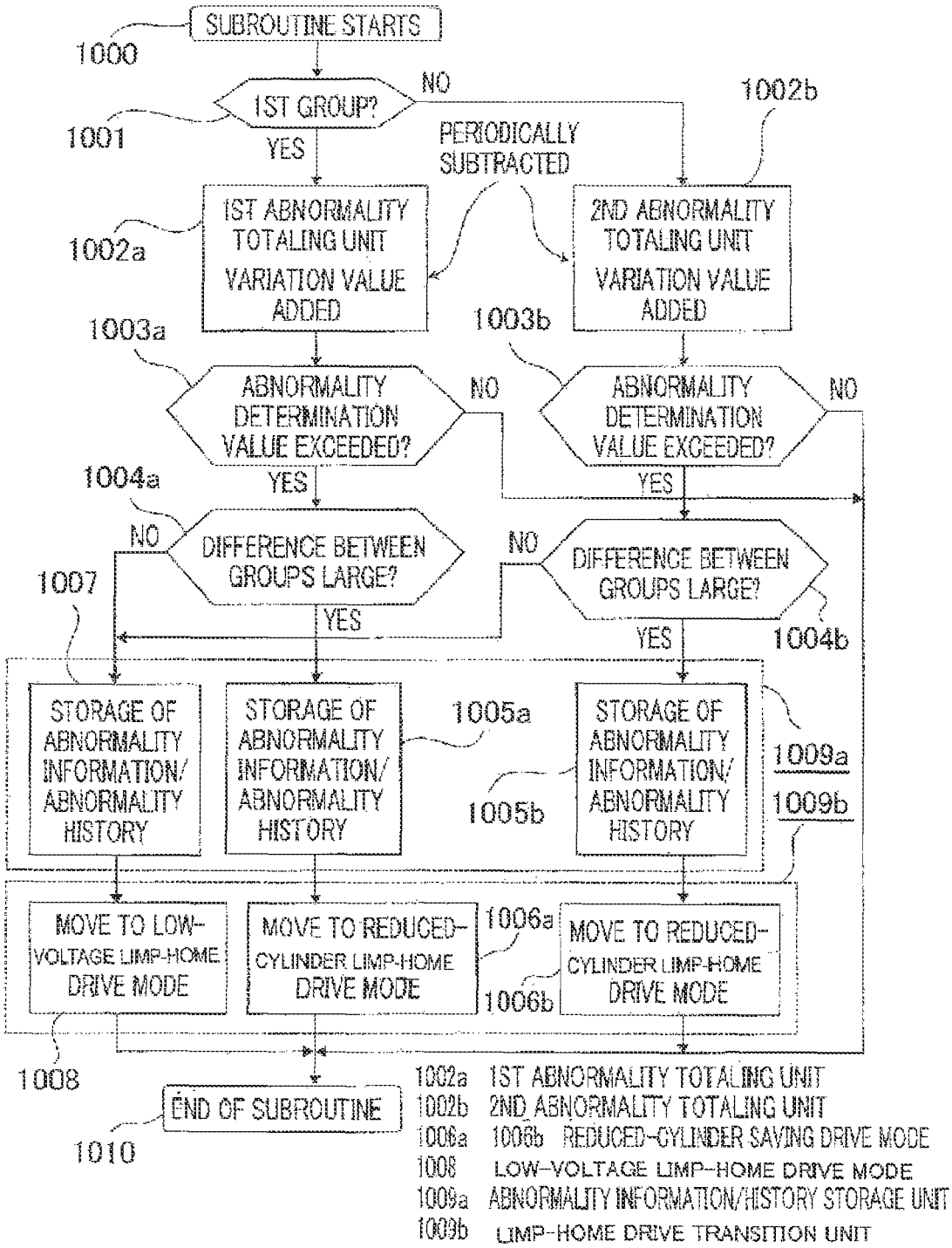
FIG. 10 is a flowchart for explaining the operation of part of the flowcharts in FIGS. 5A/5B and 9A/9B.

FIG. 10 is a flowchart for explaining the operation of part of each flowchart in FIGS. 5A/5B or FIGS. 9A/9B. FIG. 10 represents the contents of a subroutine program related to each of the step blocks 507, 517, and 527 in FIGS. 5A/B or to each of the step blocks 907, 517, and 937 in FIGS. 9A/9B; the abnormality processing represented in FIG. 10 is performed in each of the first and second monitoring abnormality processing units 507 and 907 and the first, second, third correction abnormality processing units 517, 527, and 937.

In FIG. 10, the step 1000 is a step where the subroutine program starts. In the step 1001, which is a determination step, it is determined whether the abnormality in FIGS. 5A/5B (or FIGS. 9A/9B) occurs at a time when the valve-opening command signals INJ81 and INJ84 for the first group of electromagnetic coils 81 and 84 are generated or at a time when valve-opening command signals INJ83 and INJ82 for the second group of electromagnetic coils 83 and 82 are generated; in the case where the abnormality occurs at a time when the valve-opening command signals INJ81 and INJ84 for the first group of electromagnetic coils 81 and 84 are generated, the result of the determination becomes "YES", and the step 1001 is followed by the step 1002*a*; in the case where the abnormality occurs at a time when the valve-opening command signals INJ83 and INJ82 for the second group of electromagnetic coils 83 and 82 are generated, the result of the determination becomes "NO", and the step 1001 is followed by the step 1002*b*.

In the step 1002*a* that serves as a first abnormality totaling unit, when an abnormality related to the first group occurs, a first variation value Δ1 (e.g., Δ1=3) is added to (or subtracted from) a first totaling register, which is the RAM memory 112 having a predetermined address, and when no abnormality occurs, a second variation value Δ2 (e.g., Δ2=1) that is smaller than the first variation value Δ1 is subtracted from or added to the first totaling register; in the case where no abnormality occurs continuously, as far as the present value of the first totaling register is concerned, subtraction (or addition) of the second variation value Δ2 is stopped at a normal-side limit value, which is a predetermined lower limit value (or upper limit value), for example, zero; when an abnormality continues and the present value of the first totaling register exceeds an abnormal-side limit value, which is a predetermined upper limit value (or lower limit value), for example, 15, a first abnormality occurrence is determined.

Similar operation is performed also in the step 1002*b* that serves as a second abnormality totaling unit; depending on whether or not there exists an abnormality related to the second group, the first variation value Δ1 or the second variation value Δ2 is added to or subtracted from a second totaling register, and when the present value of the second totaling register exceeds a predetermined abnormal-side limit value, a second abnormality occurrence is determined.

In the step 1003*a* following the step 1002*a*, it is determined whether or not the present value of the first totaling register in the step 1002*a* has exceeded a predetermined abnormal-side limit value, for example, 15; in the case where the present value has exceeded the predetermined abnormal-side limit value, the first abnormality occurrence is determined and the result of the determination becomes "YES", and then, the step 1003*a* is followed by the step 1004*a*; in the case where the present value is, for example, 15 or smaller and within a predetermined determination range from 0 to 15, the result of the determination becomes "NO", and the step 1003*a* is followed by the subroutine program end step 1010.

Accordingly, when an abnormality occurs sporadically due to erroneous operation caused by noise, the first abnormality occurrence is not determined; in the case where an abnormality occurs due to some sort of hardware malfunction, an abnormality is detected each time the abnormality determination is performed, and the present value of the first totaling register immediately exceeds the abnormal-side limit value; thus, the first abnormality occurrence is determined.

In the step 1003*b* following the step 1002*b*, similar operation is performed; it is determined whether or not the present value of the second totaling register in the step 1002*b* has exceeded a predetermined abnormal-side limit value; in the case where the present value has exceeded the predetermined abnormal-side limit value, the second abnormality occurrence is determined and the result of the determination becomes "YES", and then, the step 1003*b* is followed by the step 1004*b*; in the case where the present value has not exceeded the predetermined abnormal-side limit value, the result of the determination becomes "NO", and the step 1003*b* is followed by the subroutine program end step 1010.

In the step 1004*a*, which is a determination step, it is determined whether or not the difference between the respective present values of the first totaling register and the second totaling register is, for example, the same as or larger than 3; in the case where the difference is the same as or larger than 3, the result of the determination becomes "YES", and then, the step 1004*a* is followed by the step 1005*a*; in the case where the difference is smaller than 3, the result of the determination becomes "NO", and then, the step 1004*a* is followed by the step 1007. Similarly, in the step 1004*b*, which is a determination step, it is determined whether or not the difference between the respective present values of the first totaling register and the second totaling register is, for example, the same as or larger than 3; in the case where the difference is the same as or larger than 3, the result of the determination becomes "YES", and then, the step 1004*b* is followed by the step 1005*b*; in the case where the difference is smaller than 3, the result of the determination becomes "NO", and then, the step 1004*b* is followed by the step 1007.

In the case where the contributing factor of abnormality occurrence is, for example, an abnormal decrease in the boosted high voltage Vh, the cause of the abnormality is common to the first and second groups; therefore, the difference between the respective present values of the first totaling register and the second totaling register becomes small. In this regard, however, in order to prevent a difference from occurring due to the difference between the respective totaling timings of the first and second totaling registers, the difference is calculated after abnormality occurrence is determined in one of the groups and then totaling is performed in the totaling register related to the other group. In the case where the contributing factor of abnormality occurrence is, for example, short-circuiting or wire breaking in the selective opening/closing device 181, the present value of the first totaling register increases (or decreases); however, because the second totaling register is keeping its normal state, the difference between the respective present values of the first totaling register and the second totaling register becomes large.

The step block 1009*a* configured with the steps 1005*a*, 1005*b*, and 1007 serves as an abnormality report/history storage unit; in the case where after the first or the second abnormality occurrence is determined in the step 1003*a* or the step 1003*b*, the difference between the respective present values of the first totaling register and the second totaling register is the same as or larger than a predetermined value, the abnormality report/history storage unit 1009*a* determines that an abnormality has occurred in the power supply on/off device related to one of the first group of electromagnetic coils 81 and 84 and the second group of electromagnetic coils 83 and 82, the electromagnetic coil, or the load wiring system and stores an abnormality report or abnormality occurrence history information; in the case where the difference between the respective present values of the first totaling register and the second totaling register is the same as or smaller than a predetermined value, the abnormality report/history storage unit 1009*a* determines that an abnormality has occurred in the voltage boosting circuit unit 170A or 170B related to both the first group of electromagnetic coils 81 and 84 and the second group of electromagnetic coils 83 and 82 or in the power source wiring system and stores an abnormality report or abnormality occurrence history information.

In the step 1006*a* following the step 1005*a* or the step 1005, a reduced-cylinder limp-home drive mode is selected; in each of the reduced-cylinder limp-home drive modes 1006*a* and 1006*b*, all the power supply on/off devices belonging to the group in which abnormality has occurred are opened, and the limp-home drive in which the number of cylinders is halved is performed. In the step 1008 following the step 1007, a low-voltage limp-home drive mode is selected; in the low-voltage limp-home drive mode 1008, while the first and second high-voltage opening/closing device 186*a* and 186*b* are opened, the limp-home drive is performed in the low-speed drive mode utilizing the first and second low-voltage opening/closing devices 185*a* and 185*b*.

In the low-voltage limp-home drive mode 1008, the setting constants related to at least the setting cutoff current Ia0, the setting limitation peak current Ip0, and the setting target reaching time Tx0 are modified and set to the values responding to the output voltage of the vehicle battery 101. The step block 1009*b* configured with the steps 1006*a*, 1006*b*, and 1008 serves as a limp-home drive transition unit; the step block 1009*b* is followed by the subroutine program end step 1010 and then by the transit destination in FIGS. 5A/5B or FIGS. 9A/9B.

(3) Variant Example of Embodiment 2

Figure 11A:
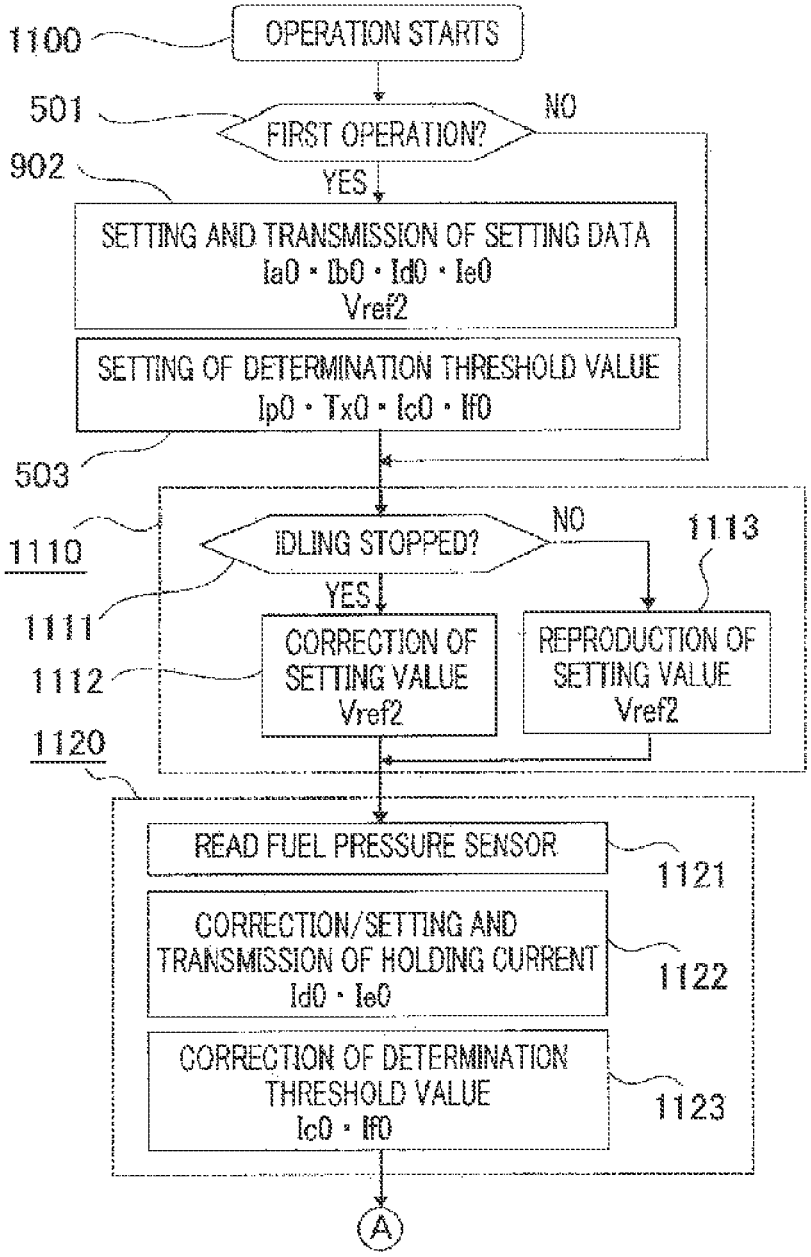
FIGS. 11A and 11B are a set of flowcharts for explaining the operation of a variant example of the vehicle engine control system according to Embodiment 2 of the present invention.
Figure 11B:
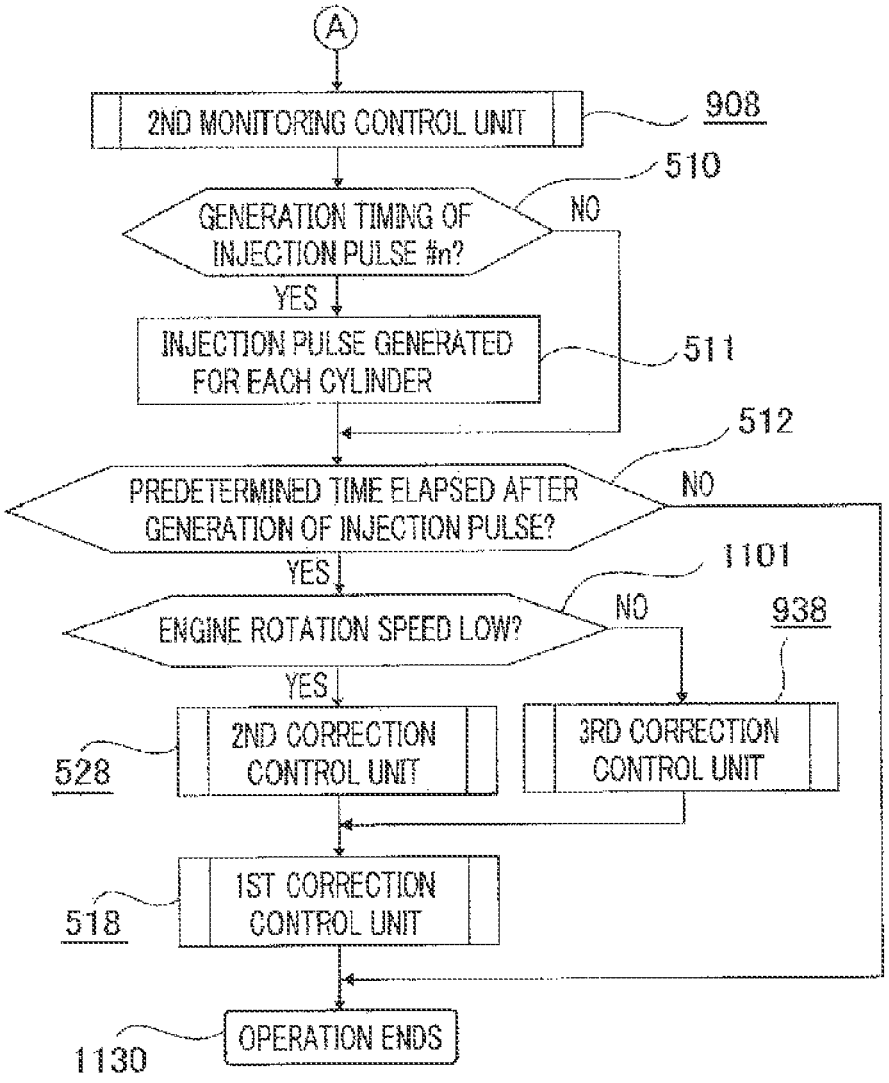

Next, there will be explained a variant example of the vehicle engine control system according to Embodiment 2 of the present invention. FIGS. 11A and 11B are a set of flowcharts for explaining the operation of a variant example of the vehicle engine control system according to Embodiment 2 of the present invention; a boosted high voltage suppression unit 1110, a holding current adjustment unit 1120, and the second correction control unit 528 are added to the program memory 113B in Embodiment 2; the holding current adjustment unit 1120 can also be added to the program memory 113A in Embodiment 1.

In FIG. 11A, the microprocessor 111 starts fuel injection control operation in the step 1100. In the step 501, it is determined, as described with reference to FIGS. 5A/5B or FIGS. 9A/9B, whether or not the present operation is the first operation in a circular control flow; in the case where the present flow is the first operation, the result of the determination becomes "YES", and then the step 501 is followed by the step 902; in the case where the present operation is the one in a following circular cycle, the result of the determination becomes "NO", and then, the step 501 is followed by the step 1111.

In the step 902, as described with reference to FIGS. 9A/9B, the setting cutoff current Ia0, the setting attenuation current Ib0, the setting downward reversal holding current Id0, and the setting upward reversal holding current Ie0, which are control constants preliminarily stored in the program memory 113B, and the value of the second threshold voltage Vref2 for determining the boosted high voltage Vh are transmitted to a predetermined address in the RAM memory 112 and to the first setting value registers 9311 through 9314 and the second setting value registers 9321 through 9324 illustrated in FIG. 8.

In the step 503, as described with reference to FIGS. 5A/5B or FIGS. 9A/9B, the setting limitation peak current Ip0, the setting target reaching time Tx0, the setting upper limit holding current Ic0, and the setting lower limit holding current If0, which are determination threshold values preliminarily stored in the program memory 113B, are transmitted to a predetermined address in the RAM memory 112. In the step 1111, which is a determination step, it is determined whether or not the engine is in the stop mode due to the idling stop; in the case where the engine is in the stop mode, the result of the determination becomes "YES", and then, the step 1111 is followed by the step 1112; immediately after the engine is started again, the result of the determination becomes "NO", and then, the step 1111 is followed by the step 1113.

In the step 1112, the value of the second threshold voltage Vref2 that has been stored in the RAM memory 112 in the step 902 is corrected and set to be, for example, the half value thereof so as to suppress an electromagnetic sound produced in the voltage boosting circuit unit 170B. In the step 1113, the second threshold voltage Vref2 that has been halved in the step 1112 is restored to the original value; the step block 1110 configured with the steps 1111, 1112, and 1113 serves as a boosted high voltage suppression unit. In the step 1121 following the step 1112 or the step 1113, a fuel pressure detection signal obtained through a fuel pressure sensor, which is one of the low-speed-change analogue sensors 104, is read.

In the step 1122, in response to the fuel pressure read in the step 1121, the values of the setting downward reversal holding current Id0 and the setting upward reversal holding current Ie0, which are stored in the RAM memory 112 in the step 902, are corrected and then transmitted again to the first and second setting value registers 9311, 9312, 9321, and 9322. In the step 1123, in response to the fuel pressure read in the step 1121, the values of the setting upper limit holding current Ic0 and the setting lower limit holding current If0, which are set in the step 503, are corrected and then transmitted again to a predetermined address of the RAM memory 112.

The values of the setting downward reversal holding current Id0, the setting upward reversal holding current Ie0, the setting upper limit holding current Ic0, and the setting lower limit holding current If0 corresponding to the fuel pressure are preliminarily stored as a data table in the program memory 113B; the step block 1120 consisting of steps 1121, 1122, and the 1123 serves as a holding current adjustment unit. The step block 908 serves as a second monitoring control unit consisting of the steps 904 through 907 in FIG. 9A.

In the step 510, which is a determination step, as described with reference to FIGS. 5A/5B, in response to a crank angle sensor, one of the opening/closing sensors 103, it is determined whether or not the present timing is the timing at which the valve-opening command signal INJn is generated; in the case where the present timing is the timing at which the valve-opening command signal INJn is generated, the result of the determination becomes "YES", and then, the step 510 is followed by the step 511; in the case where the present timing is not the timing at which the valve-opening command signal INJn is generated, the result of the determination becomes "NO", and then, the step 510 is followed by the step 512. In the step 511, the valve-opening command signal INJn (n=81 through 84) for each cylinder is generated. In the step 512, it is determined whether or not there has elapsed a predetermined time, with the elapse of which it is determined that the rapid excitation control time period has elapsed after the valve-opening command signal INJn is generated in the step 511; in the case where the predetermined time has elapsed, the result of the determination becomes "YES", and then, the step 512 is followed by the step 1101; in the case where the predetermined time has not elapsed, the result of the determination becomes "NO", and then, the step 512 is followed by the operation end step 1130.

In Embodiment 2, the steps 512*b*, 512*c*, and 512*d* in each of FIGS. 5B and 9B are omitted; thus, the first and second gate circuits 195*n* and 196*n* in each of FIGS. 3 and 8 are not utilized and hence the microprocessor 111 does not generate the reset permission command signal RSTn.

Accordingly, the monitoring storage data stored in the present value registers of the first and second high-speed timers 941 and 942, the first and peak-hold registers 951 and 952, or the first and second upper-limit hold registers 961 and 962 and the first and second lower-limit hold registers 971 and 972 is directly initialized through a reset circuit utilizing a short-time differential pulse obtained from the valve-opening command signal (INJ81 through INJ84) generated immediately before the monitoring storage operation is started. When the monitoring storage data has once been stored, this monitoring storage data is held as it is until the initialization processing is implemented at a time when the valve-opening command signals INJ81 through INJ84 are generated.

In the step 1101, which is a determination step, it is determined whether or not the engine rotation speed is low, for example, the same as or lower than 3000 [RPM]; in the case where the engine rotation speed is low, the result of the determination becomes "YES", and then the step 1101 is followed by the step block 528; in the case where the engine rotation speed is high, the result of the determination becomes "NO", and then, the step 1101 is followed by the step block 938. The step block 528 serves as the second correction control unit consisting of the steps 523 through 527 in FIG. 5B. The step block 938 serves as the third correction control unit consisting of the steps 523 through 937 in FIG. 9B.

The step block following the step block 528 or the step block 938 serves as the first correction control unit consisting of the steps 513 through 515 and the step block 517 in FIG. 5B. In the operation end step 1130, the other control programs are implemented; then, within a predetermined time, the step 1100 is resumed and then a series of operation items from the steps 1100 through 1130 is recurrently implemented.

In the foregoing explanation, the description has been made for a case where the engine is a four-cylinder engine; however, the same description can also be applied to a case where the engine is a six-cylinder engine or an eight-cylinder engine. The electromagnetic coils for driving the fuel-injection electromagnetic valves provided on the respective cylinders are divided into the first group and the second group that alternately perform fuel injection; in the same group, the valve-opening command signals INJn do not overlap with one another. However, as may be necessary, the third or the fourth group can also be added.

In the foregoing explanation, as the opening/closing device, a symbol of a junction transistor is utilized; however, in the case of a power transistor, the junction transistor can be replaced by a field-effect transistor, which is commonly utilized. Furthermore, in the foregoing explanation, in each of the auxiliary control circuit units 190A and 190B, the first setting value registers 9311 through 9314 and the second setting value registers 9321 through 9324 are provided; however, the RAM memory 112 can be utilized as the setting value register, by utilizing a direct memory access controller.

In the foregoing explanation, the microprocessor 111 spontaneously reads monitoring storage data items such as the maximum and minimum values of an opened-valve holding current from the high-speed timer and the peak-hold register; however, the auxiliary control circuit units 190A and 190B can also inform the microprocessor 111 of the reading timings for these monitoring storage data items, by use of interrupt demand signals.

Even when no interrupt signal therefor is utilized, flag information is added to the monitoring storage data created in the auxiliary control circuit units 190A and 190B; for example, in the case of a high-speed timer, the actually measured reaching time Tx is expressed by 7 bits and 1 bit of flag information is added thereto; after the timing when the excitation current Iex exceeds the setting cutoff current Ia0, the flag bit is set to "1"; thus, the microprocessor 111 can be prevented from reading erroneous data. Similarly, in the case of the peak-hold register, the flag bit is set to "1" at a timing when the excitation current Iex becomes the same as or smaller than the setting attenuation current Ib0; thus, the microprocessor 111 can be prevented from reading erroneous data.

(4) Gist and Feature of Embodiment 2

As is clear from the foregoing explanation, the vehicle engine control system 100B according to Embodiment 2 of the present invention is provided with the input/output interface circuit unit 180, for the electromagnetic coils 81 through 84, that drives the fuel-injection electromagnetic valves 108 provided on the respective cylinders of a multi-cylinder engine; the voltage boosting circuit unit 170B that generates the boosted high voltage Vh for rapidly exciting the electromagnetic coils 81 through 84; and the calculation control circuit unit 110B formed mainly of the microprocessor 111. The input/output interface circuit unit 180 is provided with the power supply control opening/closing devices including the first low-voltage opening/closing device 185*a* and the second low-voltage opening/closing device 185*b* that connect each of the first group of the electromagnetic coils 81 and 84 and the second group of the electromagnetic coils 83 and 82, which alternately perform fuel injection, with the vehicle battery 101, the first high-voltage opening/closing device 186*a* and the second high-voltage opening/closing device 186*b* that connect the first group of the electromagnetic coils 81 and 84 and the second group of the electromagnetic coils 83 and 82 with the output of the voltage boosting circuit unit 170B, and the respective selective opening/closing devices 181 through 184 separately connected with the electromagnetic coils 81 through 84; and the first current detection resistor 188*a* connected in series with the first group of the electromagnetic coils 81 and 84 and the second current detection resistor 188*b* connected with in series with the second group of the electromagnetic coils 83 and 82. The calculation control circuit unit 110B is provided with the multichannel A/D converter 114*a* that operates at a low speed and collaborates with the microprocessor 111, the multi-channel high-speed A/D converter 115, and the auxiliary control circuit unit 190B.

The low-speed-change analogue sensors 104 including an air flow sensor that detects an intake amount of the engine and a fuel pressure sensor for injection fuel are connected with the multi-channel A/D converter 114*a*; digital conversion data proportional to the signal voltage of each sensor is stored in the buffer memory 114*b* connected with the microprocessor 111 through a bus line; the analogue signal voltages proportional to the respective voltages across the first current detection resistor 188*a* and the second current detection resistor 188*b* are inputted to the high-speed A/D converter 115; respective digital conversion data pieces in the two or more channels obtained through conversion by the high-speed A/D converter are stored in the first present value register 911 and the second present value register 912; the auxiliary control circuit unit 190B is provided with the first numeral value comparators 9211 through 9214 that compare the respective values stored in the first setting value registers 9311 through 9314 with the values stored in the first present value register 911 and the second numeral value comparators 9221 through 9221 that compare the respective values stored in the second setting value registers 9321 through 9324 with the values stored in the second present value register 912, at least one of the pair of the first and second high-speed timers 941 and 942 and the pair of the first and second peak-hole resistors 951 and 952, and the first and second dedicated circuit units 191 and 192.

The first numeral value comparators 9211 through 9214 and the second numeral value comparators 9221 through 9224 compare setting data pieces that are sent from the microprocessor 111, preliminarily stored in the first setting value registers 9311 through 9314 and the second setting value registers 9321 through 9324, and serve as control constants for the excitation currents Iex for the electromagnetic coils 81 through 84 with actually measured data pieces proportional to the present values, of the excitation currents Iex, that are stored in the first and second present value registers 911 and 912; then, the first numeral value comparators 9211 through 9214 and the second numeral value comparators 9221 through 9224 generate the first determination logic outputs CMP11 through CMP14 and the second determination logic outputs CMP21 through CMP24; in response to the signal voltages, from the air flow sensor and the fuel pressure sensor, that are inputted to the multi-channel A/D converter 114*a* and the operation of the crank angle sensor, one of the opening/closing sensors 103, the microprocessor 111 determines the generation timings and the valve-opening command generation periods Tn of the valve-opening command signals INJ81 through INJ84 for the electromagnetic coils 81 through 84; in response to the valve-opening command signals INJ81 through INJ84, the first determination logic outputs CMP11 through CMP14, and the second determination logic outputs CMP21 through CMP24, the first and second dedicated circuit units 191 and 192 generate the first high-voltage opening/closing command signal A14 and the second high-voltage opening/closing command signal A32 for the first high-voltage opening/closing device 186*a* and the second high-voltage opening/closing device 186*b*, the first low-voltage opening/closing command signal B14 and the second low-voltage opening/closing command signal B32 for the first low-voltage opening/closing device 185*a* and the second low-voltage opening/closing device 185*b*, and the opening/closing command signal Drj including the selective opening/closing command signals CC1 through CC4 for the selective opening/closing devices 181 through 184.

The first (second) high-speed timers 941 (942) measures and stores, as the actually measured reaching time Tx, the time from a time point when the valve-opening command signal INJ81 or INJ84 (INJ83 or INJ82) is generated and any one of the first (second) high-voltage opening/closing devices 186*a* (186*b*) and the selective opening/closing devices 181 or 184 (183 or 184) is driven to close to a time point when the excitation current Iex for the electromagnetic coil 81 or 84 (83 or 82) reaches a predetermined setting cutoff current Ia0; the first and second peak-hold registers 951 and 952 store, as the actually measured peak currents Ip, the maximum values of the first and second present value registers 911 and 912 during a period in which the valve-opening command signals INJ81 through INJ84 are generated; the microprocessor 111 is further provided with the correction control units 518, 528, and 938 that each read monitoring storage data, which is the actually measured reaching time Tx or the actually measured peak current Ip, that each monitor the generation state of the rapid excitation current, and that each adjust the setting data for the first setting value registers 9311 through 9314 and the second setting value registers 9321 through 9324 or the valve-opening command generation periods Tn of the valve-opening command signals INJ81 through INJ84 in such a way that the amount of fuel injection by the fuel-injection electromagnetic valve 108 becomes a desired value.

The auxiliary control circuit unit 190B is provided with the first and second high-speed timers 941 and 942 that each measure and store the actually measured reaching time Tx related to the commanded excitation current for any one of the electromagnetic coils 81 through 84 during a period in which the valve-opening command signals INJ81 through INJ84 are generated; the program memory 113B that collaborates with the microprocessor 111 includes a control program that serves as the second correction control unit 938, which is one of the correction control units; the third correction control unit 938 reads the actually measured reaching time Tx, which is the monitoring storage data monitored and stored by the first and second high-speed timers 941 and 942, and adjusts in an increasing and decreasing manner the boosted high voltage Vh of the voltage boosting circuit unit 170B in accordance with the amount of the difference between a predetermined setting target reaching time Tx0 and the actually measured reaching time Tx. In the case where the rapid excitation current for the electromagnetic coil (81 through 84) rises faster than it expected, the third correction control unit 938 adjusts and shortens the boosted high voltage Vh, and in the case where the rapid excitation current for the electromagnetic coil (81 through 84) rises slower than it expected, the third correction control unit 938 adjusts and increases the boosted high voltage Vh, so that feedback control is performed in such a way that the following actually measured reaching time Tx becomes equal to the setting target reaching time Tx0.

The voltage boosting circuit unit 170B includes the induction device 171 that is on/off-excited by the voltage boosting opening/closing device 174*a*, the current detection resistor 174*b* connected in series with the induction device 171, the first comparator 175*a* that opens the voltage boosting opening/closing device 174*a* when the voltage across the current detection resistor 174*b* exceeds the first threshold voltage Vref1, the high-voltage capacitor 173 that is charged with electromagnetic energy accumulated in the induction device 171 when the voltage boosting opening/closing device 174*a* is opened and the electromagnetic energy is released through the charging diode 172, and the second comparator 178*a* that keeps the voltage boosting opening/closing device 174*a* opened when the divided voltage of the voltage across the high-voltage capacitor 173 exceeds the second threshold voltage Vref2; when being opened through the operation of the first comparator 175*a*, the voltage boosting opening/closing device 174*a* is kept opened until the charging current for the high-voltage capacitor 173 becomes smaller than a predetermined value, and then is closed again; when the charging voltage across the high-voltage capacitor 173 reaches a predetermined target value due to a plurality of on/off operations by the voltage boosting opening/closing device 174*a*, the divided voltage exceeds the second threshold voltage Vref2; the third correction control unit 938 sets the second threshold voltage Vref2 in a changeable manner and determines whether or not there exists an abnormality that the actually measured reaching time Tx, which is the monitoring storage data that has been stored in the first and second high-speed timers 941 and 942 is so long as to exceed the allowable fluctuation range of the setting target reaching time Tx0 or too short.

As described above, with regard to claim 4 of the present invention, the output voltage of the voltage boosting circuit unit is feedback-controlled in accordance with the amount of the difference between the predetermined setting target reaching time and the actually measured reaching time of the rapid excitation current, stored in each of the first and second high-speed timers.

Therefore, there is demonstrated a characteristic that a fluctuation in the fuel injection amount, which is caused by a fluctuation, in the rising characteristic of the excitation current, that is caused when the resistance value of the electromagnetic coil fluctuates due to a temperature change or when the resistance values of the wiring leads vary, is corrected so that high-accuracy fuel injection can be implemented.

In the case where in order to perform microinjection of the fuel when light-load drive such as idling rotation is implemented, the setting target reaching time is set to a short value, the boosted high voltage rises so as to shorten the actually measured reaching time, whereby the valve opening operation can be performed in a short time; therefore, there is demonstrated a characteristic that by shortening the generation period of the valve-opening command signal so as to prevent the opened-valve holding control period from occurring, the minimum fuel injection amount can be reduced.

Even when the microprocessor performs reading and correction control of the first or the second high-speed timer during the generation period of a single valve-opening command signal, the output voltage of the voltage boosting circuit unit actually completes its increase or decrease at a time when the next valve-opening command signal is generated; in the case where the engine rotation speed is extremely high, the valve-opening command period is short, and there exists no enough time to prolong the valve-opening command period, the third correction control unit, with which the output voltage of the voltage boosting circuit unit is preliminarily raised, is more effective than the second correction control unit.

The program memory 113B that collaborates with the microprocessor 111 further includes a control program that serves as the second correction control unit 528 in addition to the third correction control unit 938; the second correction control unit 528, which is utilized when the engine rotation speed is the same as or lower than a predetermined value, reads the actually measured reaching time Tx, which is the monitoring storage data monitored and stored by the first and second high-speed timers 941 and 942, and adjusts in an increasing and decreasing manner the valve-opening command generation periods Tn of the valve-opening command signals INJ81 through INJ84 in accordance with the amount of the difference between a predetermined setting target reaching time Tx0 and the actually measured reaching time Tx. In the case where the rapid excitation current for the electromagnetic coil (81 through 84) rises faster than it expected, the second correction control unit 528 adjusts and shortens the valve-opening command generation period Tn, and in the case where the rapid excitation current rises slower than it expected, the second correction control unit 528 adjusts and prolongs the valve-opening command generation period Tn, so that the actual valve opening period is corrected so as to become constant. The third correction control unit 938 is utilized when the engine rotation speed exceeds the predetermined value.

As described above, with regard to claim 5 of the present invention, the valve-opening command generation period is corrected when the engine rotation speed is low and the output voltage of the voltage boosting circuit unit is feedback-controlled when the engine rotation speed is high, in accordance with the amount of the difference between a predetermined setting target reaching time and an actually measured reaching time of the rapid excitation current, stored in each of the first and second high-speed timers.

Therefore, there is demonstrated a characteristic that a fluctuation in the fuel injection amount, which is caused by a fluctuation, in the rising characteristic of the excitation current, that is caused when the resistance value of the electromagnetic coil fluctuates due to a temperature change or when the resistance values of the wiring leads vary, is corrected so that high-accuracy fuel injection can be implemented.

In particular, in the case where the engine rotation speed is low and the valve-opening command generation period is long, the second correction control unit is utilized, so that the microprocessor can perform reading and correction-controlling of the first high-speed timer or the second high-speed timer during a single generation period of the valve-opening command signal and hence no increase in the boosted high voltage suppresses the power consumption; thus, there is demonstrated a characteristic that even when the voltage of the vehicle battery is low, the load on the vehicle battery can be reduced.

In the case where the engine rotation speed is high and the valve-opening command generation period is short, the third correction control unit is utilized, so that even when the temperature of the electromagnetic coil largely rises, the rapid excitation can be implemented; thus, there is demonstrated a characteristic that the vehicle battery can sufficiently be charged by use of a charging generator.

The program memory 113B that collaborates with the microprocessor 111 further includes a control program that serves as the boosted high voltage suppression unit 1110; the boosted high voltage suppression unit 1110 is utilized while the engine is in the idling stop mode, so that the second threshold value voltage Vref2 is set to decrease and hence the value of the boosted high voltage Vh generated by the voltage boosting circuit unit 170B is suppressed at an intermediate voltage.

As described above, with regard to claim 6 of the present invention, in the idling stop mode, the boosted high voltage is lowered to an intermediate voltage.

Accordingly, by use of the function of variably setting the boosted high voltage, the leakage current from the high-voltage capacitor in the idling stop mode is suppressed so as to save electric power, electromagnetic sound caused by voltage boosting control operation is suppressed from occurring so that abnormal noise, which is conspicuous in the silence, is cancelled, and when the engine is restarted, the high-voltage capacitor is rapidly charged from the intermediate voltage to the target high voltage; thus, there is demonstrated a characteristic that the normal fuel injection control function can be prevented from being delayed.

The input/output interface circuit unit 180 is provided with the first and second reverse-flow prevention diodes 187*a* and 187*b* that are connected in series with the first and second low-voltage opening/closing devices 185*a* and 185*b*, respectively, that are separately connected between the vehicle battery 101 and the first group of electromagnetic coils 81 and 84 and between the vehicle battery 101 and the second group of electromagnetic coils 83 and 82; the first and second high-voltage opening/closing devices 186*a* and 186*b* that are separately connected between the high-voltage power source generated by the voltage boosting circuit unit 170B and the first group of electromagnetic coils 81 and 84 and between the high-voltage power source and the second group of electromagnetic coils 83 and 82, respectively; the first group and second group of selective opening/closing devices 181, 184, 183, and 182 that are separately connected in series with the respective electromagnetic coils 81 through 84 and whose conduction timings and conduction periods are set by the microprocessor 111; the first current detection resistor 188*a* connected in series and commonly with the first group of electromagnetic coils 81 and 84; the second current detection resistor 188*b* connected in series and commonly with the second group of electromagnetic coils 83 and 82; the first commutation diode 189*a* connected in parallel with the series circuit consisting of the first group of electromagnetic coils 81 and 84, the first group of selective opening/closing devices 181 and 184, and the first current detection resistor 188*a*; and the second commutation diode 189*b* connected in parallel with the series circuit consisting of the second group of electromagnetic coils 83 and 82, the second group of selective opening/closing devices 183 and 182, and the second current detection resistor 188*b*.

The first and second high-voltage opening/closing devices 186*a* and 186*b* perform the rapid excitation control of the first group of electromagnetic coils 81 and 84 and the second group of electromagnetic coils 83 and 82, respectively; the first and second low-voltage opening/closing devices 185*a* and 185*b* perform the opened-valve holding control of the first group of electromagnetic coils 81 and 84 and the second group of electromagnetic coils 83 and 82, respectively. The rapid excitation control is implemented in the following manner: until the value of the first present value register 911 (the second present value register 912) provided in the auxiliary control circuit unit 190B reaches the setting cutoff current Ia0, which is the setting value of the first setting value register 9314 (the second setting value register 9324), the first high-voltage opening/closing device 186*a* (the second high-voltage opening/closing device 186*b*) supplies a high voltage to the electromagnetic coils 81 and 84 (the electromagnetic coils 82 and 83); after the value of the first present value register 911 (the second present value register 912) reaches the setting cutoff current Ia0, the vehicle battery 101 and the first low-voltage opening/closing device 185*a* (the second low-voltage opening/closing device 185*b*) perform sustainable power supply or the first low-voltage opening/closing device 185*a* (the second low-voltage opening/closing device 185*b*) is kept opened and the excitation current Iex is commutated and attenuated through the commutation diode 189*a* (189*b*) until the value of the first present value register 911 (the second present value register 912) is attenuated to the setting attenuation current Ib0, which is the setting value for the first setting value register 9313 (the second setting value register 9323).

The opened-valve holding control is implemented in the following manner: when the value of the first present value register 911 (the second present value register 912) provided in the auxiliary control circuit unit 190B becomes the same as or smaller than the setting upward reversal holding current Ie0, which is the setting value of the first setting value register 9311 (the second setting value register 9321), the first low-voltage opening/closing device 185*a* (the second low-voltage opening/closing device 185*b*) becomes conductive; when the value of the first present value register 911 (the second present value register 912) provided in the auxiliary control circuit unit 190A becomes the same as or larger than the setting downward reversal holding current Id0, which is the setting value of the first setting value register 9312 (the second setting value register 9322), the first low-voltage opening/closing device 185*a* (the second low-voltage opening/closing device 185*b*) becomes nonconductive, and the first group selective opening/closing devices 181 and 184 and the second selective opening/closing devices 183 and 182 are kept conductive during a period in which the valve-opening command signals INJ1 through INJ4 are generated or the first and second selective opening/closing devices 181, 184, 183, and 182 become nonconductive during a transient period in which the excitation currents for the electromagnetic coils 81 through 84 fall from the setting attenuation current Ib0 to the setting downward reversal holding current Id0; it is selected based on the valve-opening command signals INJ1 through INJ4 which one of the first low-voltage opening/closing device 185*ba* and the second low-voltage opening/closing device 185*b* becomes conductive, which one of the first high-voltage opening/closing device 186*a* and the second high-voltage opening/closing device 186*b* becomes conductive, and which one of the selective opening/closing devices 181, 184, 183, and 182 becomes conductive.

The program memory 113B that collaborates with the microprocessor 111 includes a control program that serves as the second monitoring control unit 908; the auxiliary control circuit unit 190B is provided with the first and second upper-limit value hold registers 961 and 962 and the first and second lower-limit value hold registers 971 and 972; the first and second upper-limit value hold registers 961 and 962 update and store the maximum values of the first and second present value registers 911 and 912 during the period of opened-valve holding control; the first and second lower-limit value hold registers 971 and 972 update and store the minimum values of the first and second present value registers 911 and 912 during the period of opened-valve holding control; immediately before and after the valve-opening commands through the valve-opening command signals end, the second monitoring control unit 908 reads the value of the first upper-limit value hold register 961 or the second upper-limit value hold register 962 and the value of the first lower-limit value hold register 971 or the second lower-limit value hold register 972, as the actually measured maximum holding current Ic and the actually measured minimum holding current If, and determines whether or not there exists an abnormality such as that the value of the read actually measured maximum holding current Ic exceeds a predetermined setting upper limit holding current Ic0 or that the value of the read actually measured minimum holding current If is smaller than a predetermined setting lower limit holding current If0.

As described above, with regard to claim 9 of the present invention, the auxiliary control circuit unit performs opened-valve holding control and stores the maximum and minimum values of the opened-valve holding current during the opened-valve holding period; the microprocessor reads these maximum and minimum values and compares them with predetermined setting threshold values so as to determine whether or not there exists an abnormality.

Therefore, there is demonstrated a characteristic that the rapid control load on the microprocessor is reduced and the microprocessor can rapidly and accurately determine whether or not there exists an abnormality in the holding current control performed by the auxiliary control circuit unit.

The program memory 113B that collaborates with the microprocessor 111 further includes a control program that serves as the holding current adjustment unit 1120; the holding current adjustment unit 1120 adjusts the value of the setting downward reversal holding current Id0 transmitted to the first and second setting value registers 9312 and 9322 and the value of the setting upward reversal holding current Ie0 transmitted to the first and second setting value registers 9311 and 9321, in response to the detection signal inputted from the fuel pressure sensor, which is one of the low-speed-change analogue sensors 104, to the microprocessor 111; concurrently, the holding current adjustment unit 1120 corrects the values of the setting upper limit holding current Ic0 and the setting lower limit holding current If0.

As described above, with regard to claim 10 of the present invention, the opened-valve holding current is adjusted in response to a change in the fuel pressure.

Accordingly, there is demonstrated a characteristic that the fluctuation in the operation of opening/closing the fuel-injection electromagnetic valve, which is caused by a change in the fuel pressure, is corrected and that setting threshold value for determining an abnormality can be corrected in conjunction with the fluctuation in the operation of opening/closing the fuel-injection electromagnetic valve. The holding current adjustment unit can be added to Embodiment 1.

The monitoring storage data stored in the present value registers of the first and second high-speed timers 941 and 942, the first and peak-hold registers 951 and 952, or the first and second upper-limit hold registers 961 and 962 and the first and second lower-limit hold registers 971 and 972 is directly initialized through a reset circuit utilizing a short-time differential pulse obtained from the valve-opening command signal (INJ81 through INJ84) generated immediately before the monitoring storage operation is started; alternatively, the monitoring storage data is initialized through the first and second gate circuits 195*n* and 196*n* provided in the reset circuit. The first and second gate circuits 195*n* and 196*n* are provided in the respective registers to be reset; when the microprocessor 111 generates the reset permission command signal RSTn, initialization through the valve-opening command signal (INJ81 through INJ84) becomes effective; after the monitoring and storing is completed, the present monitoring storage data is held as it is when the initialization processing is not implemented, and while the initialization is stopped, the monitoring and storing operation is not newly implemented even when the next valve-opening command signal (INJ81 through INJ84) is generated.

As described above, with regard to claim 11 of the present invention, the monitoring storage data stored in the first and second high-speed timers, the first and second peak-hold registers, the first and second upper-limit value hold registers, or the first and second lower-limit value hold registers can directly be initialized through the valve-opening command signal generated immediately before the monitoring and storing operation is started or can be initialized through the reset permission command signal generated by the microprocessor.

Accordingly, even when not initialized by the microprocessor, the registers to be directly initialized are automatically initialized; thus, there can be obtained monitoring storage data, which is updated each time the valve-opening command signal is generated.

In the case where it is desired not to reset once-stored monitoring storage data until the microprocessor completes reading of the monitoring storage data, it is only necessary to stop the reset permission command signal; thus, there is demonstrated a characteristic that the microprocessor can freely adjust the sampling cycle for the monitoring storage data. This characteristic is demonstrated also in the case of Embodiment 1.

Each of the first correction abnormality processing unit 517 that responds to the determination by the first correction control unit 518, the second (third) correction abnormality processing unit 527 (937) that responds to the determination by the second (third) correction control unit 528 (938), and the first (second) monitoring abnormality processing unit 507 (907) that responds to the determination by the first (second) monitoring control unit 508 (908) is configured with the first and second abnormality totaling units 1002*a* and 1002*b*, the abnormality report/history storage unit 1009*a*, and the limp-home drive transition unit 1009*b*; in the first abnormality totaling unit 1002*a*, when an abnormality related to the first group of electromagnetic coils 81 and 84 occurs, the first variation value Δ1 is added to (or subtracted from) the first totaling register, and when no abnormality occurs, the second variation value Δ2 that is smaller than the first variation value Δ1 is subtracted from (or added to) the first totaling register; in the case where no abnormality occurs continuously, as far as the present value of the first totaling register is concerned, subtraction (or addition) of the second variation value Δ2 is stopped at a normal-side limit value, which is a predetermined lower limit value (or upper limit value); when an abnormality continues and the present value of the first totaling register exceeds an abnormal-side limit value, which is a predetermined upper limit value (or lower limit value), a first abnormality occurrence is determined.

In the second abnormality totaling unit 1002*b*, when an abnormality related to the second group of electromagnetic coils 83 and 82 occurs, the first variation value Δ1 is added to (or subtracted from) the second totaling register, and when no abnormality occurs, the second variation value Δ2 that is smaller than the first variation value Δ1 is subtracted from (or added to) the second totaling register; in the case where no abnormality occurs continuously, as far as the present value of the second totaling register is concerned, subtraction (or addition) of the second variation value Δ2 is stopped at a normal-side limit value, which is a predetermined lower limit value (or upper limit value); when an abnormality continues and the present value of the second totaling register exceeds an abnormal-side limit value, which is a predetermined upper limit value (or lower limit value), a second abnormality occurrence is determined. In the case where after the first or the second abnormality occurrence is determined, the difference between the respective present values of the first totaling register and the second totaling register is the same as or larger than a predetermined value, the abnormality report/history storage unit 1009*a* determines that an abnormality has occurred in the power supply on/off device related to one of the first group of electromagnetic coils 81 and 84 and the second group of electromagnetic coils 83 and 82, the electromagnetic coil, or the load wiring system and stores an abnormality report or abnormality occurrence history information; in the case where the difference between the respective present values of the first totaling register and the second totaling register is the same as or smaller than a predetermined value, the abnormality report/history storage unit 1009*a* determines that an abnormality has occurred in the voltage boosting circuit unit 170A or 170B related to both the first group of electromagnetic coils 81 and 84 and the second group of electromagnetic coils 83 and 82 or in the power source wiring system and stores an abnormality report or abnormality occurrence history information.

In the case where an abnormality relates to any one of the first and second groups of electromagnetic coils 81, 84, 83, and 82, the limp-home drive transition unit 1009*b* opens all the power supply on/off devices belonging to the group in which the abnormality has occurred; then, transition is made to the reduced-cylinder limp-home drive mode 1006*a* (1006*b*) in which the number of cylinders is halved; in the case where the abnormality relates to both the groups, the limp-home drive transition unit 1009*b* opens the first and second high-voltage opening/closing devices 186*a* and 186*b*; then, transition is made to the low-voltage limp-home drive mode 1008 in which a low-speed drive utilizing the first and second low-voltage opening/closing devices 185*a* and 185*b* is implemented; in the low-voltage limp-home drive mode 1008, the setting constants related to at least the setting cutoff current Ia0, the setting limitation peak current Ip0, and the setting target reaching time Tx0 are modified and set to the values responding to the output voltage of the vehicle battery 101.

As described above, with regard to claim 12 of the present invention, the microprocessor is provided with the first, the second, or the third correction abnormality processing unit that responds to the first, the second, or the third correction control unit, the first or the second monitoring abnormality processing unit that responds to the first or the second monitoring control unit, and the first and second abnormality totaling units for the first and second groups of electromagnetic coils; by use of the abnormality report/history storage unit, the microprocessor makes distinction among abnormality occurrences related to the first-group electromagnetic coil system and the second-group electromagnetic coil system, which alternately perform fuel injection, and an abnormality occurrence related to the total systems, and then stores the abnormality report or the abnormality occurrence history information; concurrently, the microprocessor moves to the cylinder-halved limp-home drive mode or the low-voltage low-speed limp-home drive mode by use of the limp-home drive transition unit.

Accordingly, there is demonstrated a characteristic that by readily determining whether an abnormality occurrence relates to the first-group system, the second-group system, or the total system, the limp-home drive means corresponding to the abnormality occurrence system can be selected.

Even when the engine is in the limp-home drive mode where no boosted high voltage is obtained, approximately correct valve-opening control can be performed by changing and adjusting the control constants related to the rapid excitation control; thus, there is demonstrated a characteristic that low-speed limp-home drive can smoothly be implemented. This characteristic is demonstrated also in the case of Embodiment 1.

Various modifications and alterations of this invention will be apparent to those skilled in the art without departing from the scope and spirit of this invention, and it should be understood that this is not limited to the illustrative embodiments set forth herein.

What is claimed is:

1. A vehicle engine control apparatus for sequentially driving respective fuel-injection electromagnetic valves provided on cylinders of a multi-cylinder engine, comprising:

an input/output interface circuit unit for two or more groups of electromagnetic coils that drive the electromagnetic valves;

a voltage boosting circuit unit that generates a boosted high voltage for rapidly exciting the electromagnetic coils; and a calculation control circuit unit formed mainly of a microprocessor, wherein the two or more groups of electromagnetic coils include at least a first group of electromagnetic coils and a second group of electromagnetic coils, which are two or more groups of electromagnetic coils that perform fuel injection alternately and sequentially among the groups, wherein the input/output interface circuit unit is provided with a power supply control opening/closing devices including a first low-voltage opening/closing device that connects the first group of electromagnetic coils with a vehicle battery and a second low-voltage opening/closing device that connects the second group of electromagnetic coils with the vehicle battery, a first and second high-voltage opening/closing devices that are connected with the output of the voltage boosting circuit unit, respective selective opening/closing devices separately connected with the electromagnetic coils, and a first and second current detection resistors that are connected with the first and second electromagnetic coils, respectively, wherein the calculation control circuit unit is provided with a low-speed multichannel A/D converter, a high-speed multichannel A/D converter, and an auxiliary control circuit unit that collaborate with the microprocessor, wherein low-speed-change analogue sensors including an air flow sensor that detects an intake amount of the multi-cylinder engine and a fuel pressure sensor for injection fuel are connected with the multi-channel A/D converter; and digital conversion data proportional to a signal voltage of each of the sensors is stored in a buffer memory connected with the microprocessor through a bus line, wherein respective analogue signal voltages proportional to the voltages across the first and second current detection resistors are inputted to the high-speed A/D converter; and multi-input-channel digital conversion data pieces obtained by the high-speed A/D converter are stored in a first and second present value registers, wherein the auxiliary control circuit unit includes a first numeral value comparator that compares a value stored in a first setting value register with a value stored in the first present value register and a second numeral value comparator that compares a value stored in a second setting value register with a value stored in the second present value register, a first and second high-speed timers and at least one of a first and second peak-hold registers, and a first and second dedicated circuit units, wherein the first numeral value comparator and the second numeral value comparator compare setting data pieces that are sent from the microprocessor, preliminarily stored in the first setting value register and the second setting value register, and serve as control constants for excitation currents for the electromagnetic coils with actually measured data pieces proportional to the present values, of the excitation currents, that are stored in the first and second present value registers; then, the first numeral value comparator and the second numeral value comparator generate a first and second determination logic outputs, wherein in response to the signal voltages, from the air flow sensor and the fuel pressure sensor, that are inputted to the multi-channel A/D converter and the operation of the crank angle sensor, which is one of the opening/closing sensors, the microprocessor determines generation timings and valve-opening command generation periods of valve-opening command signals for the electromagnetic coils, wherein in response to the valve-opening command signals and the first and second determination logic outputs, the first and second dedicated circuit units generate opening/closing command signals including a first and second high-voltage opening/closing command signals for the first and second high-voltage opening/closing devices, a first and second low-voltage opening/closing command signals for the first and second low-voltage opening/closing devices, and selective opening/closing command signals for the selective opening/closing devices, wherein the first and second high-speed timers measure and store, as an actually measured reaching time, the time from a time point when the valve-opening command signal is generated and any one of the first and second high-voltage opening/closing devices and the selective opening/closing devices is driven to close to a time point when the excitation current for the electromagnetic coil reaches a predetermined setting cutoff current, wherein the first and second peak-hold registers store, as an actually measured peak currents, the maximum values of the first and second present value registers during a period in which the valve-opening command signals are generated, and wherein the microprocessor is further provided with correction control units that read monitoring storage data, which is the actually measured reaching time or the actually measured peak current, that monitor a generation state of the rapid excitation current, and that adjust setting data for the first and second setting value registers or a valve-opening command generation period of the valve-opening command signal in such a way that the amount of fuel injection by the fuel-injection electromagnetic valve becomes a desired value.

2. The vehicle engine control system according to claim 1, further comprising:

a program memory that collaborates with the microprocessor and includes a control program that serves as a first correction control unit, which is one of the correction control units, wherein the auxiliary control circuit unit is provided with the first and second peak-hold registers that store the maximum values of the first and second present value registers during a period in which the valve-opening command signals are generated, and wherein the first correction control unit reads and recognizes, as monitoring storage data that has been stored in the first and second peak-hold registers, the actually measured peak current related to the excitation current for any one of the two or more electromagnetic coils that operate in response to the valve-opening command signals, adjusts in an increasing or decreasing manner the setting cutoff currents, for the first and second setting value registers, that are for determining the closed-circuit period of any one of the first and second high-voltage opening/closing devices, in accordance with the amount of the difference between the recognized actually measured peak current and a predetermined setting limitation peak current, suppresses overshooting fluctuation of the rapid excitation current caused by opening-circuit response delays in the first and second high-voltage opening/closing devices, and determines whether or not there exists an abnormality that the monitoring storage data that has been stored in the first and second peak-hold registers is so large as to exceed the allowable fluctuation range of the setting limitation peak current or too small.

3. The vehicle engine control system according to claim 1, further comprising:

a program memory that collaborates with the microprocessor and includes a control program that serves as a second correction control unit, which is one of the correction control units, wherein the auxiliary control circuit unit is provided with the first and second high-speed timers that each measure and store the actually measured reaching time related to the commanded excitation current for any one of the electromagnetic coils during a period in which the valve-opening command signals are generated, and wherein the second correction control unit reads the actually measured reaching time, which is monitoring storage data monitored and stored by the first and second high-speed timers, and adjusts in an increasing and decreasing manner the valve-opening command generation periods of the valve-opening command signals in accordance with the amount of the difference between a predetermined setting target reaching time and the actually measured reaching time; in the case where the rapid excitation current for the electromagnetic coil rises faster than it expected, the second correction control unit adjusts to shorten the valve-opening command generation period, and in the case where the rapid excitation current for the electromagnetic coil rises slower than it expected, the second correction control unit adjusts to prolong the valve-opening command generation period, so that the actual valve opening period is corrected so as to become constant; and the second correction control unit determines whether or not there exists an abnormality that the actually measured reaching time, which is the monitoring storage data that has been stored in the first and second high-speed timers, is so long as to exceed the allowable fluctuation range of the setting target reaching time or too short.

4. The vehicle engine control system according to claim 1, wherein the auxiliary control circuit unit is provided with the first and second high-speed timers that each measure and store the actually measured reaching time related to the commanded excitation current for any one of the electromagnetic coils during a period in which the valve-opening command signals are generated, wherein a program memory that collaborates with the microprocessor includes a control program that serves as a third correction control unit, which is one of the correction control units, wherein the third correction control unit reads the actually measured reaching time, which is monitoring storage data monitored and stored by the first and second high-speed timers, and adjusts in an increasing and decreasing manner the boosted high voltage of the voltage boosting circuit unit in accordance with the amount of the difference between a predetermined setting target reaching time and the actually measured reaching time; in the case where the rapid excitation current for the electromagnetic coil rises faster than it expected, the third correction control unit adjusts to lower the boosted high voltage, and in the case where the rapid excitation current for the electromagnetic coil rises slower than it expected, the third correction control unit adjusts to increase the boosted high voltage, so that feedback control is performed in such a way that the following actually measured reaching time becomes equal to the setting target reaching time, wherein the voltage boosting circuit unit is provided with an induction device that is on/off-excited by a voltage boosting opening/closing device, a current detection resistor connected in series with the induction device, a first comparator that opens the voltage boosting opening/closing device when the voltage across the current detection resistor exceeds a first threshold voltage, a high-voltage capacitor that is charged with electromagnetic energy accumulated in the induction device when the voltage boosting opening/closing device is opened and the electromagnetic energy is released through a charging diode, and a second comparator that keeps the voltage boosting opening/closing device opened when a divided voltage of the voltage across the high-voltage capacitor exceeds a second threshold voltage; when being opened through the operation of the first comparator, the voltage boosting opening/closing device is kept opened until the charging current for the high-voltage capacitor becomes smaller than a predetermined value, and then is closed again; and when the charging voltage across the high-voltage capacitor reaches a predetermined target value due to a plurality of on/off operations by the voltage boosting opening/closing device, the divided voltage exceeds the second threshold voltage, and wherein the third correction control unit sets the second threshold voltage in a changeable manner and determines whether or not there exists an abnormality that the actually measured reaching time, which is the monitoring storage data that has been stored in the first and second high-speed timers, is so long as to exceed the allowable fluctuation range of the setting target reaching time or too short.

5. The vehicle engine control system according to claim 4, wherein the program memory that collaborates with the microprocessor further includes a control program that serves as a second correction control unit in addition to the third correction control unit, wherein the second correction control unit is utilized when the engine rotation speed is the same as or lower than a predetermined value; the second correction control unit reads the actually measured reaching time, which is monitoring storage data monitored and stored by the first and second high-speed timers, and adjusts in an increasing and decreasing manner the valve-opening command generation period of the valve-opening command signal in accordance with the amount of the difference between a predetermined setting target reaching time and the actually measured reaching time; in the case where the rapid excitation current for the electromagnetic coil rises faster than it expected, the second correction control unit adjusts to shorten the valve-opening command generation period, and in the case where the rapid excitation current for the electromagnetic coil rises slower than it expected, the second correction control unit adjusts to prolong the valve-opening command generation period, so that the actual valve opening period is corrected so as to become constant, and wherein the third correction control unit is utilized when the engine rotation speed exceeds the predetermined value.

6. The vehicle engine control system according to claim 4, wherein the program memory that collaborates with the microprocessor further includes a control program that serves as a boosted high voltage suppression unit; and the boosted high voltage suppression unit is utilized while the engine is in the idling stop mode, so that the second threshold value voltage is set to decrease and hence the value of the boosted high voltage generated by the voltage boosting circuit unit is suppressed at an intermediate voltage.

7. The vehicle engine control system according to claim 1, wherein the input/output interface circuit unit is provided with a first and second reverse-flow blocking diodes that are connected in series with the first and second low-voltage opening/closing devices, respectively, that are separately connected between the vehicle battery and the first group of electromagnetic coils and between the vehicle battery and the second group of electromagnetic coils; the first and second high-voltage opening/closing devices that are separately connected between the high-voltage power source generated by the voltage boosting circuit unit and the first group of electromagnetic coils and between the high-voltage power source and the second group of electromagnetic coils, respectively; the first and second selective opening/closing devices that are connected in series with each of the two or more electromagnetic coils and whose conduction timings and conduction periods are set by the microprocessor; the first current detection resistor connected in series and commonly with the first group of electromagnetic coils; the second current detection resistor connected in series and commonly with the second group of electromagnetic coils; a first fly-wheel diode connected in parallel with a series circuit consisting of the first group of electromagnetic coils, the first group of selective opening/closing devices, and the first current detection resistor; and a second fly-wheel diode connected in parallel with a series circuit consisting of the second group of electromagnetic coils, the second group of selective opening/closing devices, and the second current detection resistor, wherein the first and second high-voltage opening/closing devices perform rapid excitation control of the first group of electromagnetic coils and the second group of electromagnetic coils, respectively, and the first and second low-voltage opening/closing devices perform opened-valve holding control of the first group of electromagnetic coils and the second group of electromagnetic coils, respectively, wherein in the rapid excitation control, until the value of the first present value register or the second present value register provided in the auxiliary control circuit unit reaches the setting cutoff current, which is the setting value of the first setting value register or the second setting value register, the first high-voltage opening/closing device or the second high-voltage opening/closing device supplies a high voltage to the electromagnetic coils; and after the value of the first present value register or the second present value register reaches the setting cutoff current, the vehicle battery and the first low-voltage opening/closing device or the second low-voltage opening/closing device perform sustainable power supply or the first low-voltage opening/closing device or the second low-voltage opening/closing device is kept opened and the excitation current is commutated and attenuated through the fly-wheel diode until the value of the first present value register or the second present value register is attenuated to the setting attenuation current, which is the setting value for the first setting value register or the second setting value register, wherein in an opened-valve holding control, when the value of the first present value register or the second present value register provided in the auxiliary control circuit unit becomes the same as or smaller than a setting upward reversal holding current, which is the setting value for the first setting value register or the second setting value register, the first low-voltage opening/closing device or the second low-voltage opening/closing device becomes conductive; and when the value of the first present value register or the second present value register becomes the same as or larger than a setting downward reversal holding current, which is the setting value for the first or the second setting value register, the first or the second low-voltage opening/closing device becomes nonconductive, and wherein the first and second group of selective opening/closing devices are kept conductive during a period in which the valve-opening command signal is being generated, or become nonconductive during a transient period in which the excitation current for the electromagnetic coils falls from the setting attenuation current to the setting downward reversal holding current; and it is selected based on the valve-opening command signals which one of the first low-voltage opening/closing device and the second low-voltage opening/closing device becomes conductive, which one of the first high-voltage opening/closing device and the second high-voltage opening/closing device becomes conductive, and which one of the selective opening/closing devices becomes conductive.

8. The vehicle engine control system according to claim 7, further comprising:

a program memory that collaborates with the microprocessor and includes a control program that serves as a first monitoring control unit, wherein the first monitoring control unit reads the value of the first present value register or the second present value register during the opened-valve holding control period and determines whether or not there exists an abnormality such as that a moving-average value of a read opened-valve holding current is larger than a predetermined setting upper limit holding current or smaller than a predetermined setting lower limit holding current.

9. The vehicle engine control system according to claim 7, wherein a program memory that collaborates with the microprocessor includes a control program that serves as a second monitoring control unit, and the auxiliary control circuit unit is provided with a first and second upper-limit value hold registers and a first and second lower-limit value hold registers, wherein the first and second upper-limit value hold registers update and store the maximum values of the first and second present value registers during the period of opened-valve holding control, wherein the first and second lower-limit value hold registers update and store the minimum values of the first and second present value registers during the period of opened-valve holding control, and wherein immediately before and after the valve-opening commands through the valve-opening command signals end, the second monitoring control unit reads the value of the first upper-limit value hold register or the second upper-limit value hold register and the value of the first lower-limit value hold register or the second lower-limit value hold register, as an actually measured maximum holding current and an actually measured minimum holding current, and determines whether or not there exists an abnormality such as that the value of the read actually measured maximum holding current exceeds a predetermined setting upper limit holding current or that the value of the read actually measured minimum holding current is smaller than a predetermined setting lower limit holding current.

10. The vehicle engine control system according to claim 8, wherein the program memory that collaborates with the microprocessor further includes a control program that serves as a holding current adjustment unit, and wherein the holding current adjustment unit adjusts the value of the setting downward reversal holding current transmitted to the first and second setting value registers and the value of the setting upward reversal holding current transmitted to the first and second setting value registers, in response to the detection signal inputted from the fuel pressure sensor, which is one of the low-speed-change analogue sensors, to the microprocessor; concurrently, the holding current adjustment unit corrects the values of the setting upper limit holding current and the setting lower limit holding current.

11. The vehicle engine control system according to claim 9, wherein the program memory that collaborates with the microprocessor further includes a control program that serves as a holding current adjustment unit, and wherein the holding current adjustment unit adjusts the value of the setting downward reversal holding current transmitted to the first and second setting value registers and the value of the setting upward reversal holding current transmitted to the first and second setting value registers, in response to the detection signal inputted from the fuel pressure sensor, which is one of the low-speed-change analogue sensors, to the microprocessor; concurrently, the holding current adjustment unit corrects the values of the setting upper limit holding current and the setting lower limit holding current.

12. The vehicle engine control system according to claim 1, wherein monitoring storage data stored in the present value registers of the first and second high-speed timers, the first and peak-hold registers is directly initialized through a reset circuit utilizing a short-time differential pulse obtained from the valve-opening command signal generated immediately before the monitoring storage operation is started; alternatively, the monitoring storage data is initialized through a first and second gate circuits provided in the reset circuit, wherein the first and second gate circuits are provided in the respective registers to be reset; when the microprocessor generates a reset permission command signal, initialization through the valve-opening command signal becomes effective, and wherein with regard to the monitoring storage data, after the monitoring and storing is once completed, the present monitoring storage data is held as it is when the initialization processing is not implemented, and while the initialization is stopped, the monitoring and storing operation is not newly implemented even when the next valve-opening command signal is generated.

13. The vehicle engine control system according to claim 8, further comprising:

a correction abnormality processing unit that responds to a determination by the correction control unit and adjusts setting date for the first and second setting value registers or a valve-opening command generation period of the valve-opening command signal, and a first monitoring abnormality processing unit that responds to a determination by the first monitoring control unit and is configured with a first and second abnormality totaling units, an abnormality report/history storage unit, and a limp-home drive transition unit, wherein in the first abnormality totaling unit, when an abnormality related to the first group of electromagnetic coils occurs, a first variation value is added to or subtracted from the first totaling register, and when no abnormality occurs, a second variation value that is smaller than the first variation value is subtracted from or added to the first totaling register; in the case where no abnormality occurs continuously, as far as the present value of the first totaling register is concerned, subtraction or addition of the second variation value is stopped at a normal-side limit value, which is a predetermined lower limit value or upper limit value; when an abnormality continues and the present value of the first totaling register exceeds an abnormal-side limit value, which is a predetermined upper limit value or lower limit value, a first abnormality occurrence is determined, wherein in the second abnormality totaling unit, when an abnormality related to the second group of electromagnetic coils occurs, a first variation value is added to or subtracted from the second totaling register, and when no abnormality occurs, a second variation value that is smaller than the first variation value is subtracted from or added to the second totaling register; in the case where no abnormality occurs continuously, as far as the present value of the second totaling register is concerned, subtraction or addition of the second variation value is stopped at a normal-side limit value, which is a predetermined lower limit value or upper limit value; when an abnormality continues and the present value of the second totaling register exceeds an abnormal-side limit value, which is a predetermined upper limit value or lower limit value, a second abnormality occurrence is determined, wherein in the case where after the first or the second abnormality occurrence is determined, the difference between the respective present values of the first totaling register and the second totaling register is the same as or larger than a predetermined value, the abnormality report/history storage unit determines that an abnormality has occurred in the power supply on/off device related to one of the first group of electromagnetic coils and the second group of electromagnetic coils, the electromagnetic coil, or the load wiring system and stores an abnormality report or abnormality occurrence history information; in the case where the difference between the respective present values of the first totaling register and the second totaling register is the same as or smaller than the predetermined value, the abnormality report/history storage unit determines that an abnormality has occurred in the voltage boosting circuit unit related to both the first group of electromagnetic coils and the second group of electromagnetic coils or in the power source wiring system and stores an abnormality report or abnormality occurrence history information, and wherein in the case where an abnormality relates to any one of the first and second groups of electromagnetic coils, the limp-home drive transition unit opens all the power supply on/off devices belonging to the group in which the abnormality has occurred, and then, transition is made to a reduced-cylinder limp-home drive mode in which the number of cylinders is halved; in the case where the abnormality relates to both the groups, the limp-home drive transition unit opens the first and second high-voltage opening/closing devices, and then, transition is made to a low-voltage limp-home drive mode in which a low-speed drive utilizing the first and second low-voltage opening/closing devices is implemented; in the low-voltage limp-home drive mode, setting constants related to at least the setting cutoff current, the setting limitation peak current, and the setting target reaching time are modified and set to the values responding to the output voltage of the vehicle battery.

14. The vehicle engine control system according to claim 9, wherein a correction abnormality processing unit that responds to a determination by the correction control unit, that adjust setting date for the first and second setting value registers or a valve-opening command generation period of the valve-opening command signal, and a second monitoring abnormality processing unit that responds to a determination by the second monitoring control unit is configured with a first and second abnormality totaling units, an abnormality report/history storage unit, and a limp-home drive transition unit, wherein in the first abnormality totaling unit, when an abnormality related to the first group of electromagnetic coils occurs, a first variation value is added to or subtracted from the first totaling register, and when no abnormality occurs, a second variation value that is smaller than the first variation value is subtracted from or added to the first totaling register; in the case where no abnormality occurs continuously, as far as the present value of the first totaling register is concerned, subtraction or addition of the second variation value is stopped at a normal-side limit value, which is a predetermined lower limit value or upper limit value; when an abnormality continues and the present value of the first totaling register exceeds an abnormal-side limit value, which is a predetermined upper limit value or lower limit value, a first abnormality occurrence is determined, wherein in the second abnormality totaling unit, when an abnormality related to the second group of electromagnetic coils occurs, a first variation value is added to or subtracted from the second totaling register, and when no abnormality occurs, a second variation value that is smaller than the first variation value is subtracted from or added to the second totaling register; in the case where no abnormality occurs continuously, as far as the present value of the second totaling register is concerned, subtraction or addition of the second variation value is stopped at a normal-side limit value, which is a predetermined lower limit value or upper limit value; when an abnormality continues and the present value of the second totaling register exceeds an abnormal-side limit value, which is a predetermined upper limit value or lower limit value, a second abnormality occurrence is determined, wherein in the case where after the first or the second abnormality occurrence is determined, the difference between the respective present values of the first totaling register and the second totaling register is the same as or larger than a predetermined value, the abnormality report/history storage unit determines that an abnormality has occurred in the power supply on/off device related to one of the first group of electromagnetic coils and the second group of electromagnetic coils, the electromagnetic coil, or the load wiring system and stores an abnormality report or abnormality occurrence history information; in the case where the difference between the respective present values of the first totaling register and the second totaling register is the same as or smaller than the predetermined value, the abnormality report/history storage unit determines that an abnormality has occurred in the voltage boosting circuit unit related to both the first group of electromagnetic coils and the second group of electromagnetic coils or in the power source wiring system and stores an abnormality report or abnormality occurrence history information, and wherein in the case where an abnormality relates to any one of the first and second groups of electromagnetic coils, the limp-home drive transition unit opens all the power supply on/off devices belonging to the group in which the abnormality has occurred, and then, transition is made to a reduced-cylinder limp-home drive mode in which the number of cylinders is halved; in the case where the abnormality relates to both the groups, the limp-home drive transition unit opens the first and second high-voltage opening/closing devices, and then, transition is made to a low-voltage limp-home drive mode in which a low-speed drive utilizing the first and second low-voltage opening/closing devices is implemented; in the low-voltage limp-home drive mode, setting constants related to at least the setting cutoff current, the setting limitation peak current, and the setting target reaching time are modified and set to the values responding to the output voltage of the vehicle battery.

* * * * *